US008695464B2

(12) United States Patent
Herrmann

(10) Patent No.: US 8,695,464 B2
(45) Date of Patent: Apr. 15, 2014

(54) PLIERS WITH PIVOT PIN THAT CAN BE MOVED AGAINST THE FORCE OF A SPRING

(75) Inventor: Bernd Herrmann, Wuppertal (DE)

(73) Assignee: Knipex-Werk C. Gustav Putsch KG, Wuppertal (DE)

( * ) Notice: Subject to any disclaimer, the term of this patent is extended or adjusted under 35 U.S.C. 154(b) by 1145 days.

(21) Appl. No.: 12/312,062

(22) PCT Filed: Oct. 24, 2007

(86) PCT No.: PCT/EP2007/061378

§ 371 (c)(1), (2), (4) Date: Jun. 29, 2009

(87) PCT Pub. No.: WO2008/049850

PCT Pub. Date: May 2, 2008

(65) Prior Publication Data

US 2010/0064861 A1 Mar. 18, 2010

(30) Foreign Application Priority Data

Oct. 24, 2006 (DE) ..... 10 2006 050 645
Oct. 11, 2007 (DE) ..... 10 2007 049 032

(51) Int. Cl.
*B25B 7/10* (2006.01)

(52) U.S. Cl.
USPC ..... 81/409; 81/413; 81/410; 81/412

(58) Field of Classification Search
USPC ..... 81/405–414
See application file for complete search history.

(56) References Cited

U.S. PATENT DOCUMENTS 2,557,296 A * 6/1951 Kress ..... 81/412
2,779,224 A * 1/1957 Coggburn ..... 81/3.44
(Continued)

FOREIGN PATENT DOCUMENTS

DE 958 459 2/1957
DE 299 07 864 7/1999
(Continued)

OTHER PUBLICATIONS

International Search Report.

*Primary Examiner* — Monica Carter
*Assistant Examiner* — Melanie Alexander
(74) *Attorney, Agent, or Firm* — Collard & Roe, P.C.

(57) ABSTRACT

The invention relates to a pair of pliers (1) with two pliers legs (2, 3) crossing at a joint pin (4), one (3) of which legs is movable and the other (2) is fixed, and with a spring (13) between the fixed leg (2) and the joint pin (4) acting in such a way as to support interlocking engagement of the joint pin (4), wherein the pliers legs (2, 3) form gripping portions (5, 6) on one side of the joint pin (4) and a pliers mouth is formed on the other side of the joint pin (4), wherein furthermore the joint pin (4), through which a pivot axis (A) of the movable pliers leg at the same time extends, is adjustable in a longitudinal slot (9) of the fixed pliers leg (2), and wherein the movable pliers leg (3) can be optionally fixed in relation to the fixed pliers leg (2) by means of interlocking engagement between the joint pin (4) and the longitudinal slot (9) that takes place in the direction of a plane defined by the pliers legs (2, 3). To design and develop a pair of pliers of the type in question in such a way that different handling characteristics are advantageously obtained, it is proposed that the joint pin (4) is released from the interlock merely by tensile loading of the movable pliers leg (3) transversely in relation to the longitudinal extent of the longitudinal slot (9).

19 Claims, 31 Drawing Sheets

(56) References Cited

U.S. PATENT DOCUMENTS

| | | | | |
|---|---|---|---|---|
| 3,199,599 | A * | 8/1965 | Kammerer, Jr. | 166/173 |
| 4,048,878 | A | 9/1977 | Nystrom | |
| 4,269,089 | A * | 5/1981 | Hastings | 81/409.5 |
| 4,773,288 | A * | 9/1988 | Jang et al. | 81/409.5 |
| 6,467,380 | B1 | 10/2002 | Azkona | |
| 6,497,165 | B1 | 12/2002 | Schulz et al. | |
| 6,892,609 | B2 * | 5/2005 | Kuo | 81/413 |
| 7,503,243 | B2 | 3/2009 | Putsch | |

FOREIGN PATENT DOCUMENTS

| | | |
|---|---|---|
| EP | 0 421 107 | 4/1991 |
| EP | 0 528 252 | 2/1993 |
| EP | 1 245 338 | 10/2002 |
| GB | 10112 | 0/1912 |
| WO | WO 2004/103646 | 12/2004 |

* cited by examiner 1
7
8
4
A
11
17
10
13
15
G
24
14
β
B
α
9
12
3
6
2

PLIERS WITH PIVOT PIN THAT CAN BE MOVED AGAINST THE FORCE OF A SPRING

CROSS REFERENCE TO RELATED APPLICATIONS

This application is the National Stage of PCT/EP2007/061378 filed on Oct. 24, 2007, which claims priority under 35 U.S.C. §119 of German Application No. 10 2006 050 645.6 filed on Oct. 24, 2006 and German Application No. 10 2007 049 032.3 filed on Oct. 11, 2007. The international application under PCT article 21(2) was not published in English.

The invention relates in first instance to a pair of pliers with two pliers legs crossing at a pivot pin, one of which legs is movable and the other is fixed, and with a spring between the fixed leg and the pivot pin acting in such a way as to assist interlocking engagement of the pivot pin, the pliers legs forming gripping portions on one side of the pivot pin and a pliers mouth being formed on the other side of the pivot pin, furthermore the pivot pin, through which a pivot axis of the movable pliers leg at the same time extends, being adjustable in a longitudinal slot of the fixed pliers leg, and it additionally being possible for the movable pliers leg to be fixed by choice in relation to the fixed pliers leg by means of interlocking engagement between the pivot pin and the longitudinal slot that takes place in the direction of a plane defined by the pliers legs.

Pliers with two pliers legs crossing at a pivot pin in which the opening width of the pliers mouth can be changed by adjustment of the pivot pin in a longitudinal slot have already become known in various configurations. Reference may firstly be made, for example, to GB 10112; also to EP 528 252 A1. In the case of these known pliers, the interlocking engagement for adjustability in steps takes place by a movement of the pivot pin perpendicularly in relation to a plane defined by the pliers legs. The pivot pin of these known pliers is also assisted into interlocking engagement by a spring, to be specific in the case of the known pliers, a spring biased into the interlocking engagement. For this purpose, the spring is supported on the movable pliers leg.

For prior art, further reference may be made to WO 2004/103646 A2. In the case of this pair of pliers, the pliers mouth is automatically adjusted inward when an object to be manipulated with the pliers is gripped. The pivot pin comes into interlocking engagement with corresponding teeth of a flank of the longitudinal slot in the direction of a plane defined by the pliers legs. However, the action of the spring is such that there is at least the tendency for the interlocking engagement to be overcome as a result. Since, furthermore, the spring loads the movable pliers leg constantly in the opening direction of the pliers mouth, the pliers mouth is always open to the greatest possible extent in the starting position.

For prior art, reference may also be made to DE 958 459, which relates to a pair of pliers with adjustable mouth width. The pivot pin is mounted in a slide which can be displaced in a sliding manner in the longitudinal slot of the fixed leg, by means of which slide the interlocking engagement between the pivot pin and the longitudinal slot is achieved. This engagement is assisted by a spring holding the slide against the tooth formation of the slot.

Against the background of the last-mentioned prior art, it is an object of the invention to design and develop the known pliers in such a way as to obtain advantageously different handling characteristics.

This object is achieved first and foremost in the case of the subject matter of Claim 1, it being provided that the pivot pin is released from the interlock merely by pulling loading of the movable pliers leg transversely in relation to the longitudinal extent of the longitudinal slot. Decisively different handling is obtained as a result. Once set, a mouth opening width is retained, even after appropriate use, until such time as it may be deliberately adjusted. Nevertheless, the mouth opening width is adjustable without requiring manipulation of the pivot pin itself. An adjustment of the mouth width can be carried out merely by pulling movement of the movable pliers leg in the plane defined by the pliers legs, without manual actuation of the pivot pin itself. This does not necessarily require the movable leg to be swung up in order to overcome the interlocking engagement. Accordingly, it is also possible for it to be overcome in such a way when operating in confined spaces that do not allow the long legs to be pivoted in relation to one another. The pulling loading of the movable pliers leg transversely in relation to the longitudinal extent of the longitudinal slot does not necessarily have to be directed at right angles to the longitudinal slot—with respect to a plane extending transversely in relation to the pin axis. Rather, in this respect the term "transversely" includes an angular range of from a few degrees up to, for example, 10°, 20° or more about the right angle. If the movable leg is pulled within this angular range, the pivot pin is released from the interlock.

The invention also relates to a pair of pliers according to the features of the precharacterizing clause of Claim 1 or according to Claim 1, it being proposed here, in order to achieve advantageously different handling characteristics, that the interlock can be overcome at choice by moving the pivot pin counter to the force of the spring or by moving the pivot pin in the direction of the pivot axis. These features are explained with respect to the initially drafted independent Claim 2. However, they may in principle also be combined with the features of Claim 1. The pivot pin can first be moved out of the interlocking engagement by a displacement transverse to the pivot axis of the movable pliers leg. However, it is further preferred for this not to be the only possible movement for releasing the interlocking engagement. Rather, it is preferred in this context with regard to an actually configured pair of pliers for the pivot pin—also—to be able to be moved out of the interlock by a displacement in the direction of the pivot axis of the movable pliers leg. To this extent, the actuation coincides with that known from the aforementioned EP 528 252 A1. The user consequently has the possibility of using one or the other type of adjustment, as equivalent options or according to the particular application.

The further features of the invention are explained below with reference to the initially drafted subclaims. However, they may in principle also be of importance without one or more of the features described above.

For instance, it is provided in a development of the subject matter of the invention that the movement of the pivot pin is accompanied by a turning about the pivot axis. The displacement of the pivot pin, in particular transversely in relation to the pivot axis, accordingly coincides with a turning of the same, in the course of which rotational displacement of the pivot pin, the interlocking engagement between the pivot pin and the longitudinal slot of the movable pliers leg is overcome. After that, the teeth of the pivot pin assume a position spaced away from the tooth formation of the longitudinal slot, whereby an adjustment of the pliers legs in relation to one another can be achieved, in particular in the sense of enlarging the width of the mouth. As a result, a further advantageous possibility for adjustment is obtained for the user. The movement and turning of the pivot pin into interlocking engagement or out of interlocking engagement preferably takes place solely by relative displacement of the pliers legs in relation to one another. The turning of the pivot pin about the pivot axis may take place solely by pulling on the movable pliers leg, carrying the pivot pin, transversely in relation to the longitudinal extent of the longitudinal slot, this occurring, for example, while a pivot pin portion is supported on a flank of the longitudinal slot. Furthermore, the turning of the pivot pin may, however, also be brought about by structural design measures in the region of interaction with the pivot pin. In this respect, it is proposed, for example, that the turning is achieved by an off-center actuation of the pivot pin with respect to the longitudinal slot. By this actuation, forced guidance in the turning direction of the pivot pin is achieved. The actuation of the pivot pin takes place in this case off-center of the longitudinal slot, i.e. preferably laterally offset in relation to a center line of the longitudinal slot, which at the same time is the line followed by the longitudinal pivot axis of the pivot pin, whereby the turning direction is predetermined under corresponding actuation.

Moreover, it is proposed in this respect that the off-center actuation is achieved as a result of abutment of the pivot pin against an end portion of the longitudinal slot, so furthermore against a slot base connecting the longitudinal edge flanks of the longitudinal slot. In interaction with this end portion, corresponding actuation of the pivot pin has the effect that the latter is brought out of interlocking engagement by turning about the longitudinal axis, this actuation that brings about the turning of the pivot pin preferably being provided only in the region of one end of the longitudinal slot and also preferably in the range of the most minimal opening of the mouth width. Alternatively or in combination with this, corresponding actuation of the pivot pin may also take place in the opposite end region of the longitudinal slot. With corresponding introduction of force via the pliers legs, the actuation of the pivot pin by the end portion of the longitudinal slot leads to forced guidance of the pivot pin to overcome the interlocking engagement.

It is further preferred in this respect for the pivot pin and/or the end portion of the longitudinal slot to have an actuating projection. If this projection is formed on the pivot pin, a one-part configuration is preferred in this respect, this furthermore being in the manner of a camming projection which is approximately radially directed with respect to the pivot pin axis and interacts with the facing base flank of the longitudinal slot. Alternatively, this base flank of the longitudinal slot may itself be provided with the actuating projection, which is disposed off-center with respect to the longitudinal center axis of the longitudinal slot and acts on the pivot pin in such a way that the latter turns out of interlocking engagement. As a further alternative, both the base flank of the longitudinal slot and the pivot pin may have off-center projections, disposed in a way corresponding to the interaction. If the actuating projection alone is formed on the pivot pin, the base flank of the longitudinal slot acts in the manner of a cam flank.

In a further alternative configuration, which however is possibly also suitable for being used in combination, the pivot pin may also be captured with positively locking engagement in a pliers leg such that it is rotationally driven along by the pivoting movement, it only beginning to be carried along by the pivoting movement when the pliers mouth is partially open. Accordingly, the rotational driving takes place under forced control by way of a pivoting of the pliers legs in relation to one another about the pin axis. It is preferred in this respect for the pivot pin to be captured with positively locking engagement in the movable pliers leg. It is further preferred for the forced rotational driving of the pivot pin, to overcome the interlocking engagement, only to take place when the opening of the pliers mouth exceeds the usual opening width of the pliers mouth, in order to bring the pliers away from the part that is to be gripped. Accordingly, the rotational displacement of the pivot pin to overcome the interlock can be carried out deliberately, in that the pliers mouth is opened beyond the usual extent, thus for example enclosing a pliers mouth opening angle of more than 20°, furthermore, for example, 25° or 30°. In a preferred configuration, this positively engaging rotational driving of the pivot pin can be carried out in any interlocking position along the longitudinal slot, enabling the user to set a different width of the pliers mouth in any pliers mouth width position by means of simple rotational displacement of the pliers legs, which proves to be of advantage in particular in areas that are difficult to access, as well as in areas that conform to German VDE regulations. The user does not have to grasp the pivot pin to adjust the pliers mouth. Rather, the hands remain on the pliers legs, which are correspondingly insulated in a preferred manner.

The positively engaging connection for the rotational driving of the pivot pin by way of a pliers leg is achieved in a preferred configuration by the pivot pin having a radially extending driving projection, which engages in a radially inner driving recess of the pliers leg having the bore that accommodates the pivot pin. The driving recess thereby offers the engaging driving projection a freedom within the usual handling of the pliers, so that no positively locking driving of the pivot pin is brought about during usual opening and closing of the pliers mouth and corresponding turning of the movable pliers leg about the pivot pin axis. Only pivoting displacement of the movable pliers leg beyond the usual extent to which the pliers mouth is opened leads to rotational driving of the pivot pin by way of a boundary area of the driving recess. So, furthermore, when considered in the circumferential direction, the driving recess has a width which allows usual opening of the pliers mouth up to an opening angle of 20 to 25° without positively locking driving of the pivot pin.

If, in combination with this, the pivot pin is also formed for displacement of the same in the direction of the pivot axis to overcome the interlocking engagement, the user is offered one or the other type of adjustment. It is further preferred in this context for the driving recess to have at least an axial depth which corresponds to the travel when the pivot pin moves in the direction of the pivot axis plus the axial thickness of the driving projection. Matching the axial depth of the driving recess, the driving projection of the pivot pin may have a corresponding axial length. It is alternatively provided in this respect that the driving projection only has such an axial depth that it lies in the driving recess in the position in which it is unloaded by the user in the direction of the pivot axis; on the other hand, in the loaded position, to overcome the interlocking engagement, it leaves the driving recess by displacement of the pivot pin in the direction of the pivot axis. Furthermore, the driving recess may represent an aperture in the periphery of the bore receiving the pivot pin, which aperture opens toward the longitudinal slot of the fixed pliers leg. Accordingly, the longitudinal slot may also serve for receiving the driving projection when the pivot pin is pressed down.

It is further preferred for the spring only to act upon the pivot pin. It is accordingly supported on the one hand on the fixed leg and on the other hand on the pivot pin. Thus there is no provision for it also to act on further elements, for instance also on the movable pliers leg. On the other hand, the movable pliers leg is of course also acted upon by the spring indirectly, by way of the corresponding portions of the pivot pin that fit in the bores of the movable pliers leg.

In particular, it is also preferred for the spring to act directly between the fixed leg and the pivot pin. There is indeed preferably no deflection or transmission of the spring force, for instance by means of a lever.

With regard to the interaction with the fixed leg, it is additionally preferred for the spring to be supported on a portion of the fixed leg that defines the longitudinal slot. There is consequently a very close locational relationship between the two supporting points for the spring, these being the pivot pin and the fixed leg. The spring can be comparatively small. A compact construction is made possible.

The slot width of the longitudinal slot is preferably chosen throughout such that the pivot pin is movable in the longitudinal slot transversely in relation to the longitudinal extent of the latter, to be precise preferably in any interlocking position corresponding to a mouth width.

With regard to the further configuration of the interaction of the pivot pin with the spring, it is also preferred for the spring to be accommodated in the pivot pin with a direction of action that is transverse to the longitudinal axis of the latter. Consequently, an actual parallelism of the direction of action of the spring in relation to the plane defined by the pliers legs can also be achieved.

It is further preferred for the spring to act on a spherical body, at least with respect to its interaction with the fixed leg, and then for the spring body for its part to interact with the fixed leg. For this purpose, the spherical body may suitably be held in a bore of the pivot pin, in which the spring is also accommodated. To this extent, the bore may be partially closed-off in the usual way with the spherical body located in it, so that the ball is not lost even when the pair of pliers is taken apart. On the other hand, this is not absolutely necessary, since the retention of the spherical body may also be ensured operationally, that is except when it is dismantled, by some other positively locking engagement, for instance by the forming of a passage in the fixed leg.

With further preference, the pivot pin is formed in a cross-section, at least in the region interacting with the fixed leg, such that, during interlocking engagement, the pivot pin lies against the opposite flank, partially directly and partially by way of the spring element. This has the advantage that, if suitably designed, the direct abutment can absorb the force of reaction when the pliers are actuated.

To offer the user a possible way of securing the opening width of the pliers mouth once it has been set, it is appropriate for the pivot pin to be blocked in such a way as to prevent the interlocking engagement from being overcome, or for this only to be made possible when the blocking is overcome. So it is provided in a preferred configuration of the pliers that the spring can be electively disabled in such a way that it does not act to disengage the interlock. In a preferred configuration, the spring acting upon the ball supported on a longitudinal edge flank of the longitudinal slot is prevented from becoming compressed, which brings about a blocking of the pivot pin supported by way of the spring and the ball. This blocking position can be deliberately brought about, for example by corresponding structural means on the pivot pin or on the pliers leg or legs. For example, a pin or the like on the pivot pin may be brought into a blocking position, furthermore for example to engage in the escape space for the pivot pin, necessary for overcoming the interlock. It is preferred in this respect for a pin which is movable in the direction of movement of the pivot pin in the direction of the pivot axis to be provided in the pivot pin to disable the spring. This pin acts directly or indirectly upon the spring in such a way that the latter cannot be compressed. Accordingly, the ball acted upon by the spring also cannot retract, as is necessary for the displacement of the pivot pin transversely in relation to its pivot axis.

With regard to the longitudinal slot, it is additionally preferred for only one longitudinal flank of the fixed pliers leg to be formed with a tooth formation, with which engaging teeth of the pivot pin then respectively interact. The other, non-toothed longitudinal flank, is preferably smooth.

In addition, it is preferred for the tooth formation that is formed on the fixed pliers leg to define flank angles which can be run over in the closing direction of the pliers mouth. As a result, direct placement of the pliers mouth on the object is made possible. This is on account of the described configuration of the pivot pin, that is to say by simple movement of the pliers legs in relation to one another in their longitudinal direction. An adjusting actuation of the pivot pin is not required. The pivot pin thereby runs over the tooth formation in a ratchet-like manner. This is in turn achieved by the spring, which makes the ratchet-like movement possible.

It is particularly preferred in this context for the flank angle of a tooth formed on the fixed pliers leg, the counter tooth, with which an engaging tooth of the pivot pin comes into interaction when the movable pliers leg is displaced in the closing direction of the pliers mouth, to enclose a much smaller angle with a longitudinal axis of the longitudinal slot than the counter flank of the counter tooth against which the corresponding engaging tooth of the pivot pin is supported when the pair of pliers is actuated. Specifically, this is also dependent on the tooth geometry of the pivot pin. It must be ensured that the running over is ensured in the closing direction of the mouth, but on the other hand stable holding action is achieved in the opening direction of the pliers mouth. Angles of the tooth flank of between 20° and 60°, with respect to the smaller angle, and 80° to 110°, with respect to the greater angle, are suitable. The latter tooth flank (greater angle) may also in principle be negatively directed, therefore have an undercut with respect to a line perpendicular to said longitudinal axis.

If to this extent one also wishes to speak of sweeping of the teeth (when considered in cross-section), the engaging teeth of the pivot pin interacting with them are swept in the opposite direction. Accordingly, when considered in the engaged state, opposite or equal conditions are obtained with respect to the flanks.

As to be explained further below, as a departure from a straight longitudinal axis, the longitudinal slot may also have a curved longitudinal center line. To this extent, one speaks in the context described here of a respective tangent to the center line or a corresponding linear connection, not in the geometrical sense of a longitudinal axis, between end points of the longitudinal slot.

With further preference, the pivot pin has two opposite, flattened sides, only one of the sides being provided with pivot pin teeth that are formed for the interlocking engagement.

The invention is further explained below with reference to the accompanying drawing, which however merely represents a number of exemplary embodiments and in which:

FIG. 9 shows a representation according to FIG. 8, but seen transversely in relation to the longitudinal direction of the longitudinal slot;

FIG. 33 shows a representation corresponding to FIG. 18, but for a further embodiment, in which the pivot pin is prevented from turning in the interlocking position by a blocking pin which can be swung in;

Figure 1:
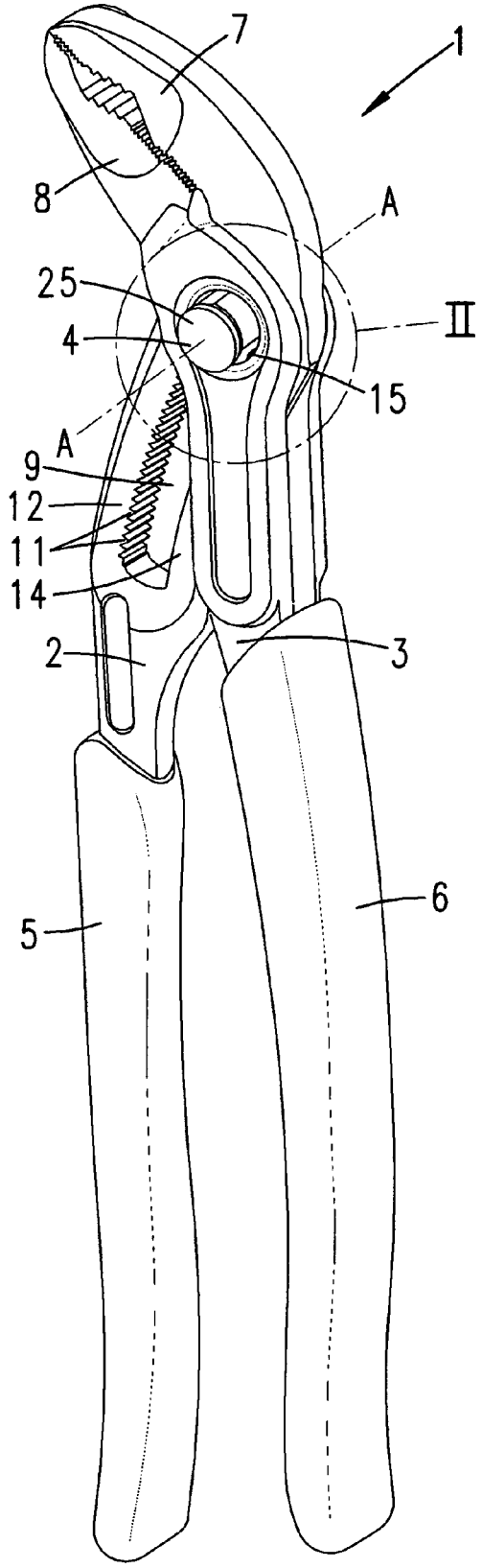
FIG. 1 shows the pliers in a perspective oblique view, for a first embodiment.
Figure 3:
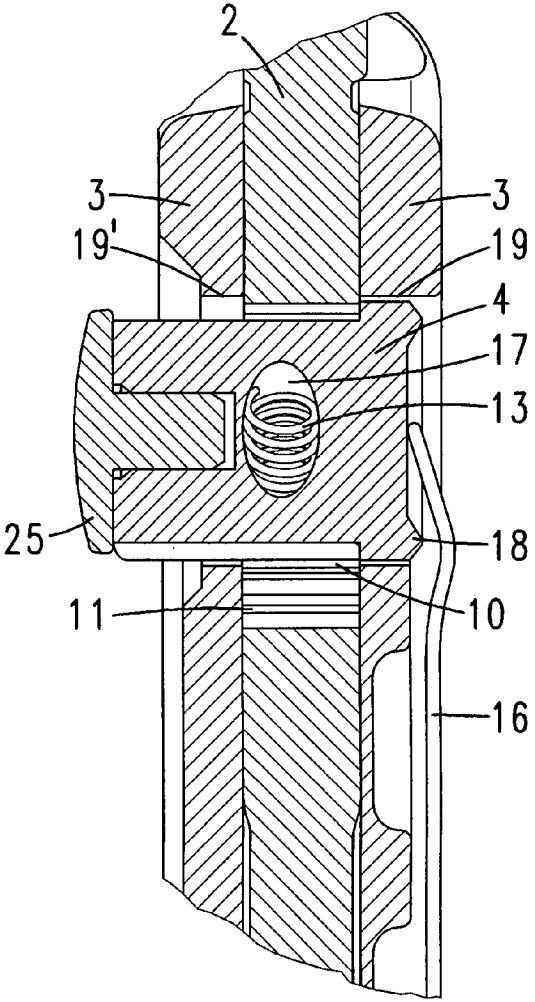
FIG. 3 shows a cross-section through the item according to FIG. 1 and FIG. 2, in section along the line in FIG. 2.
Figure 2:
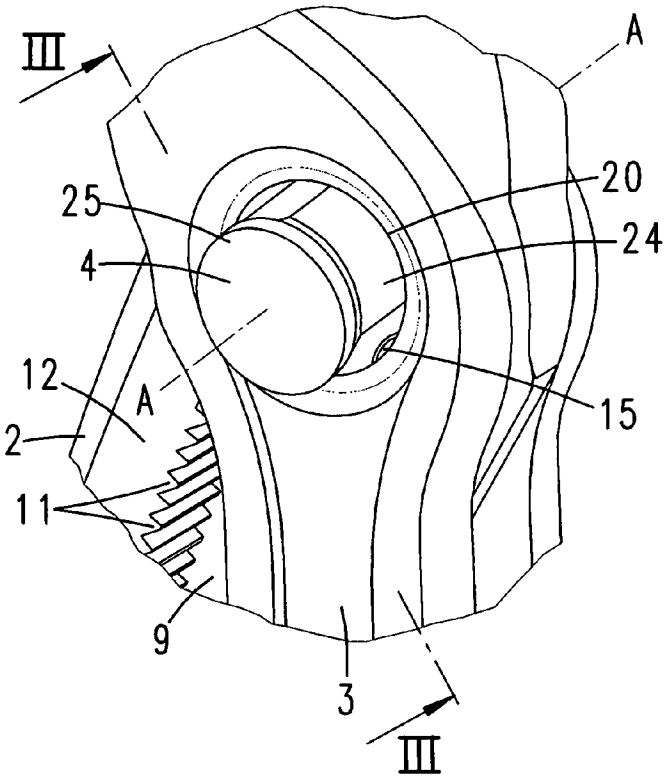
FIG. 2 shows an enlargement of the portion II taken from FIG. 1.

Represented and described, in first instance with reference to FIGS. 1 to 6, is a pair of pliers 1 in a first embodiment of the water pump pliers (pipe wrench) kind, with two pliers legs 2, 3. The pliers legs 2, 3 cross at a pivot pin 4.

The pliers leg 2 is a fixed pliers leg. The pliers leg 3 is movable in relation to the pliers leg 2, for changing the mouth width.

The pliers legs 2, 3 form gripping portions 5, 6 on one side of the pivot pin 4 and pliers jaws 7 and 8 on the other side of the pivot pin 4. Associated with the crossing region of the legs 2 and 3, the fixed leg 2 is provided with a longitudinal slot 9. The pivot pin 4 engages through said slot.

The movable pliers leg 3 is fork-shaped in the crossing region, for flanking both sides of the fixed leg portion having the longitudinal slot 9. The pivot pin 4 is pivotably held in the fork portions of the movable leg 3.

The pivot pin 4 has radially outwardly directed engaging teeth 10, which interact with counter teeth 11, disposed in the longitudinal slot 9 along an associated flank 12, for fixing the movable pliers leg 3 in terms of sliding.

The interlocking engagement of the pivot pin 4 with respect to the tooth formation of the longitudinal slot is assisted by a spring 13 acting on the pin 4, here in the form of a cylindrical compression spring. This spring lies in a radially outwardly open bore 17 that is directed radially in relation to the pin axis, and is supported with its free end, protruding radially beyond the pin 4, on the flank 14 of the longitudinal slot 9 that is opposite the flank 12 having the counter teeth 11.

The support does not take place directly on the flank 14 but rather indirectly with a ball 15 interposed.

The movable pliers leg 3 is pivotably mounted on the fixed pliers leg 2 by way of its bores 19, 19', through which the pivot pin 4 passes, the pin axis defining the pivot axis A.

Formed in the fixed pliers leg 2 is a longitudinal slot 9 (cf. also FIG. 4 in particular), in which the pivot pin 4 is adjustable, and consequently at the same time so is the movable pivot leg 3.

It can be seen that a plane (family of planes, extending perpendicularly in relation to the pivot axis A) is defined at the same time by the pliers legs 2, 3. In a direction oriented on this plane, or with a movement in this plane, an interlocking engagement takes place between the pivot pin 4, to be specific the engaging teeth 10 thereof, cf. also FIG. 4, and the counter teeth 11, which are formed on a flank 12 of the longitudinal slot 9. As a result, the movable pliers leg 3 is adjustable in steps in relation to the fixed pliers leg 2 by an engaging tooth 10 and a counter tooth 11 running one over the other in a ratchet-like manner—in the case of movement in the closing direction of the pliers mouth—and by active disengaging movement of the teeth 10, 11, displacement by at least one tooth width and restoration of the interlocking engagement because of spring force—in the case of movement in the opening direction of the pliers mouth.

A flank of a counter tooth 11 to be run over by the pivot pin during the displacement in the mouth closing direction encloses an angle $\alpha$ of about 40° with a longitudinal axis (here in fact a tangent to the longitudinal axis of the curved longitudinal slot 9), while the counter flank of the same counter tooth 11 encloses an angle $\beta$ of about 95° with the longitudinal axis.

Figure 4:
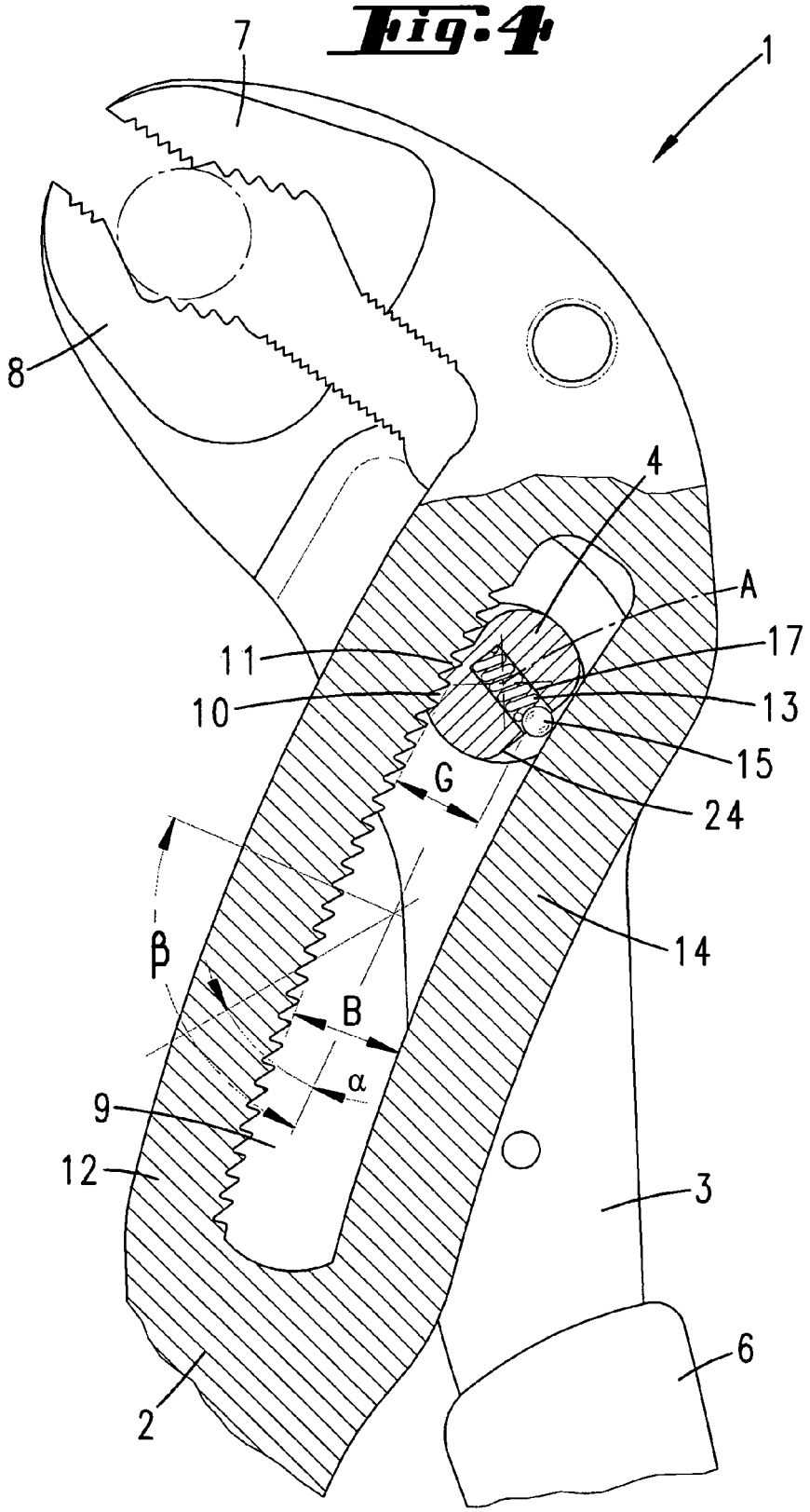
FIG. 4 shows a cross-section through the item according to FIG. 1 and FIG. 2, in section in the plane of the fixed leg, limited to the longitudinal slot in the fixed leg.

The interlocking engagement between the pivot pin 4 and the longitudinal slot 9, that is in fact the teeth 11 of the flank 12 of the longitudinal slot 9, is assisted by a spring 13 acting directly between the fixed leg 2 and the pivot pin 4, cf. for instance FIG. 4. In the case of the exemplary embodiment, the engaging teeth 10 lie with prestress in the troughs between the counter teeth 11.

It is evident that, apart from its support on the fixed leg 2, the spring 13 only acts upon the pivot pin 4. With the exception of, or by way of, the ball 15, the support is directly between the pivot pin 4 and the flank 14 of the fixed leg 2. The spring 13 is supported on said flank by way of said ball 15. On account of the ball 15, a very low coefficient of friction, which is advantageous with regard to adjustment, is achieved between the pivot pin 4, or the spring 13, and the fixed leg 2.

The pair of pliers 1 represented can be adjusted in two respects; on the one hand in principle in a conventional manner, as also described, for example, in EP 528 252 A1, cited at the beginning, by pressing down the pivot pin 4 in the direction of the pivot axis A. For this purpose, a pressure spring 16 formed as a leg spring (see also FIG. 3) acts on the pivot pin 4 in the direction of the pivot axis A, in opposition to its upper actuating side. Furthermore, for this purpose the pivot pin 4 is formed on its underside with an uninterruptedly encircling peripheral bead 18. The spring 16 therefore cannot for instance slip off the pivot pin 4. In the case of the exemplary embodiment, the spring 16 is a leaf spring—slightly angled away at the front, in the region of interaction with the pivot pin.

Figure 5:
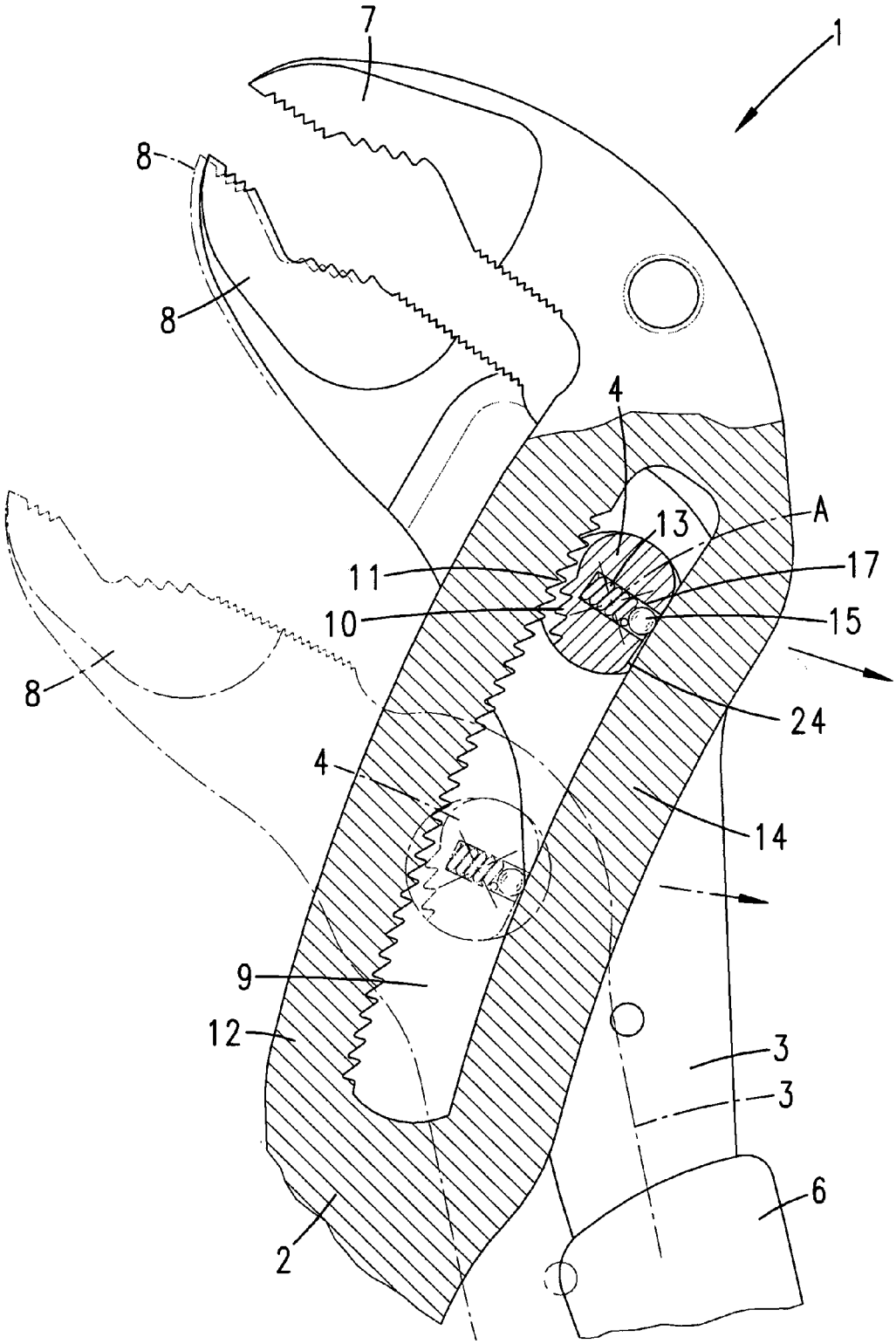
FIG. 5 shows a representation according to FIG. 4, the pivot pin being disengaged merely by pulling loading of the movable pliers leg.

On the other hand, as also primarily described here, the pivot pin 4 may be adjusted by merely displacing the pliers legs 2, 3 in relation to one another in said plane. This specifically involves initially achieving a pressing displacement of the pivot pin 4 counter to the action of the spring 13 into a position according to FIG. 5 or FIG. 6 by applying pressure by way of the bore 19 (FIG. 3), possibly also on corresponding guiding portions 20, in the opposite bore portion 19' of the fork-shaped movable pliers leg 3, after which a displacement in the longitudinal direction of the longitudinal slot 9 to the desired extent is readily possible. For this purpose, a width B of the longitudinal slot 9, see for instance FIG. 4, is chosen such that displacement of the pivot pin in the longitudinal direction of the longitudinal slot 9 is made possible even in the disengaged state of the pivot pin 4, in which the teeth are therefore no longer in interengagement (FIG. 5). When said application of pressure to the pivot pin 4 by way of the movable pliers leg 3 is stopped, the interlocking engagement between the pivot pin 4 and the toothed flank of the longitudinal slot 9 is resumed at this point in the longitudinal slot 9 on account of the action of the spring 13.

As can be gathered from the representation shown in FIG. 5, the pivot pin 4 can be released from the interlock merely by pulling loading of the movable pliers leg 3 transversely in relation to the longitudinal extent of the longitudinal slot 9. As represented in FIG. 5, this pulling loading may take place substantially perpendicularly in relation to the longitudinal center line of the curved longitudinal slot 9, this occurring from the working position that is reproduced by dash-dotted lines in FIG. 5. In the course of this predominantly linear displacement of the movable pliers leg 3, the pivot pin 4 is actuated substantially by way of the bore 19, which has the consequence of the counter teeth 10 on the pivot pin moving out as a result of a linear support of said pivot pin 4, allowing pivoting thereof, on the flank 14 of the longitudinal slot 9 that is opposite the counter teeth 11. A torque is imparted to the pivot pin 4 by the pulling loading acting on it, this occurring furthermore while overcoming the force of the spring 13 lying in the bore 17 and acting on the flank 14 by way of the ball 15.

Figure 6:
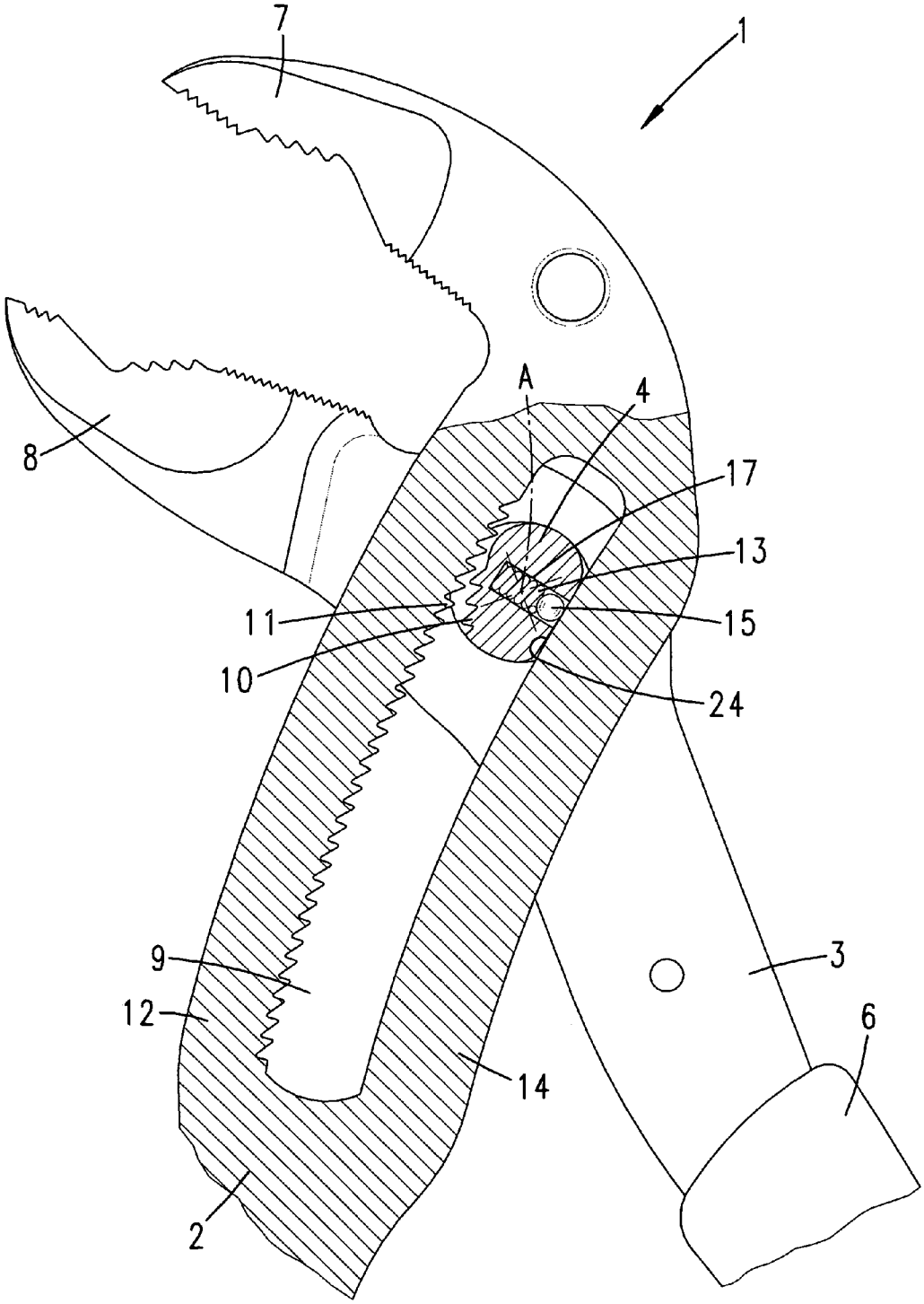
FIG. 6 shows a representation corresponding to FIG. 5, with simultaneous pivoting of the movable pliers leg.
Figure 7:
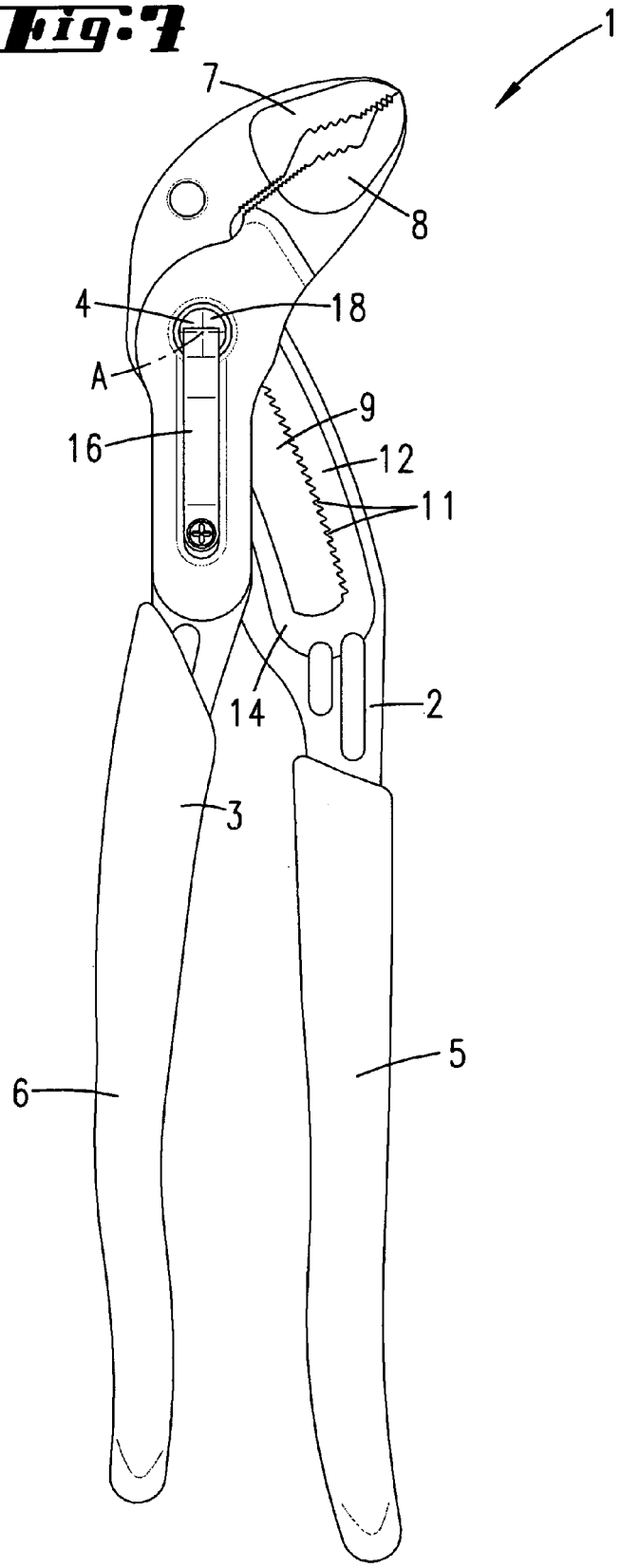
FIG. 7 shows a view from below of the pliers according to FIG. 1.
Figure 6:
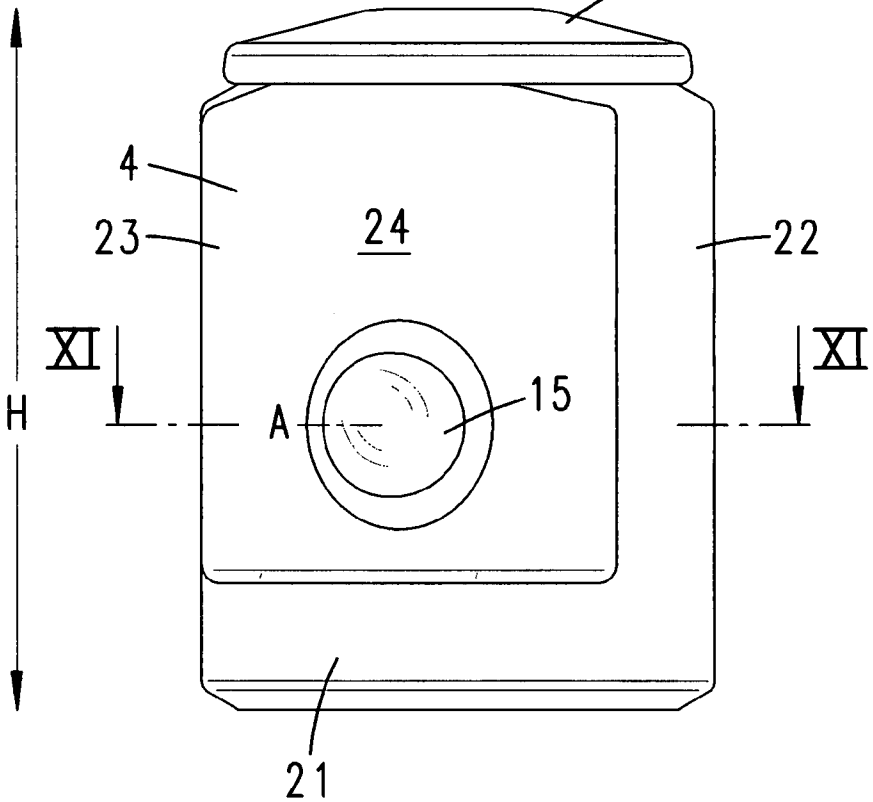

As further represented in FIG. 6, the pulling loading of the movable pliers leg 3 transversely in relation to the longitudinal axis of the longitudinal slot 9 may also coincide with a pivoting of the pliers leg 3 about the pivot axis A of the pivot pin 4. The pivoting of the movable pliers leg 3 alone does not lead to the interlock between the pivot pin 4 and the counter teeth 11 being overcome.

Figure 10:
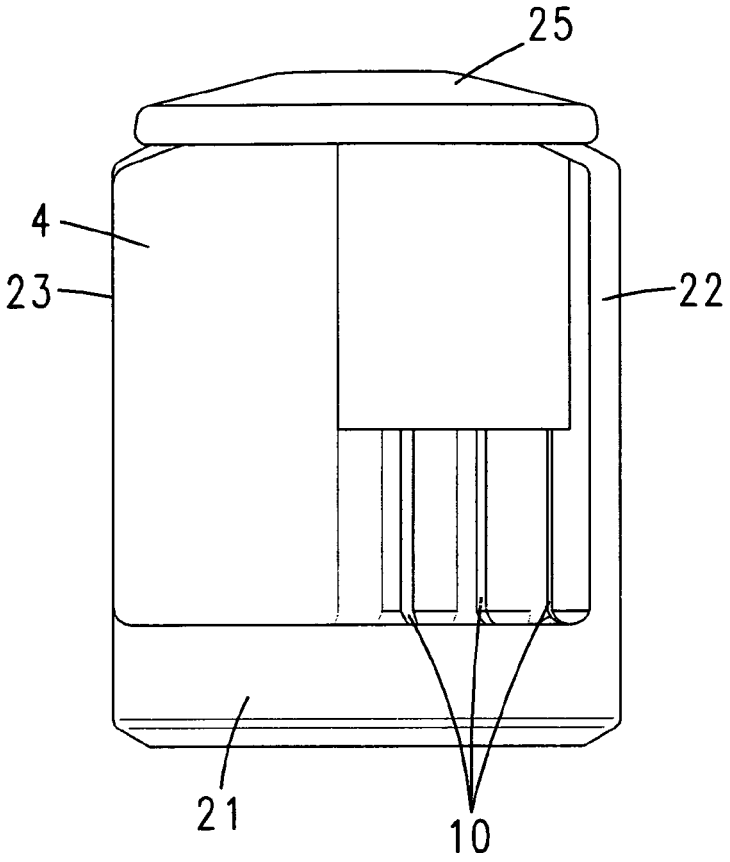
FIG. 10 shows a representation according to FIG. 9, but seen from the opposite direction.

On account of the special shaping of the pivot pin 4 in cross-section, as can be seen for instance from FIG. 4, but also from FIG. 10, the pivot pin 4 has as it were, seen in the longitudinal direction of the longitudinal slot 9, on the one hand a portion, on the side of the spring 13 toward the mouth, which corresponds approximately to the free width B of the longitudinal slot 9 and on the other hand, on the side of the spring 13 away from the mouth, a portion of a width G, which in any, event is less than the width B approximately by the extent of the tooth engagement (the width G is also related to the free width of the longitudinal slot 9). Moreover, as revealed by the representations mentioned, this region of the cross-section of the pivot pin 4 is also formed in a narrowing manner, as seen in the longitudinal direction of the longitudinal slot 9. The narrow region faces away from the mouth. Said width G is obtained directly in the peripheral region of the bore 17 away from the mouth (see for instance FIG. 11), which accommodates the spring 13. The narrowing, which in the cross-section mentioned is represented in the form of a virtually straight area, already begins on the mouth side of the bore 17.

The cross-section of the pivot pin 4, with respect to the representation in FIG. 4, is also substantially trapezoidal, the transverse areas of the trapezoid being rounded. These transverse areas of the trapezoid partially form supporting zones in the bores 19 and 19' of the movable pliers leg (see also FIG. 3). In this relationship, the ball 15 breaks through one longitudinal side of the trapezoid.

Figure 8:
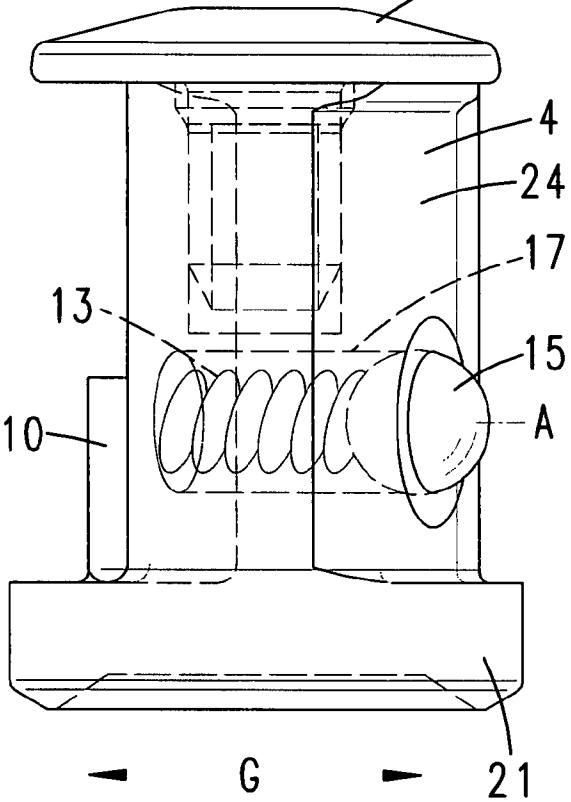
FIG. 8 shows a representation of the pivot pin on its own, seen in the longitudinal direction of the longitudinal slot.

As revealed in particular by FIGS. 8 to 10, the pivot pin 4 is formed in the vertical direction firstly by a lower, preferably circular, base 21, which, with the diameter dimension of this base, merges with the previously referred to narrow sides 22, 23 of the trapezoid. Offset downward with respect to the overall height H of the pivot pin 4, i.e. toward the base 21, the bore 17 is formed. The extent of offset corresponds here approximately to half the diameter, that is to say approximately to the radius of the bore 17.

A center axis of the bore 17, which is perpendicular to the area 24 in which the ball 15 emerges, extends in a way corresponding to a diameter line of the circular base 21 (seen in a plane transverse to the longitudinal axis of the pivot pin 4 which coincides with the pivot axis A already referred to further above).

The bore 17 is moreover a blind bore, that is to say does not emerge on the opposite side.

Figure 11:
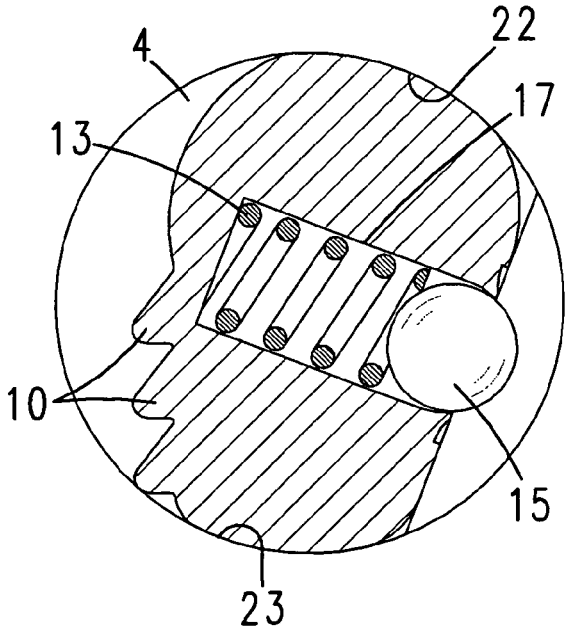
FIG. 11 shows a cross-section through the item according to FIGS. 8 to 10, in section along the line XI-XI in FIG. 9.
Figure 12:
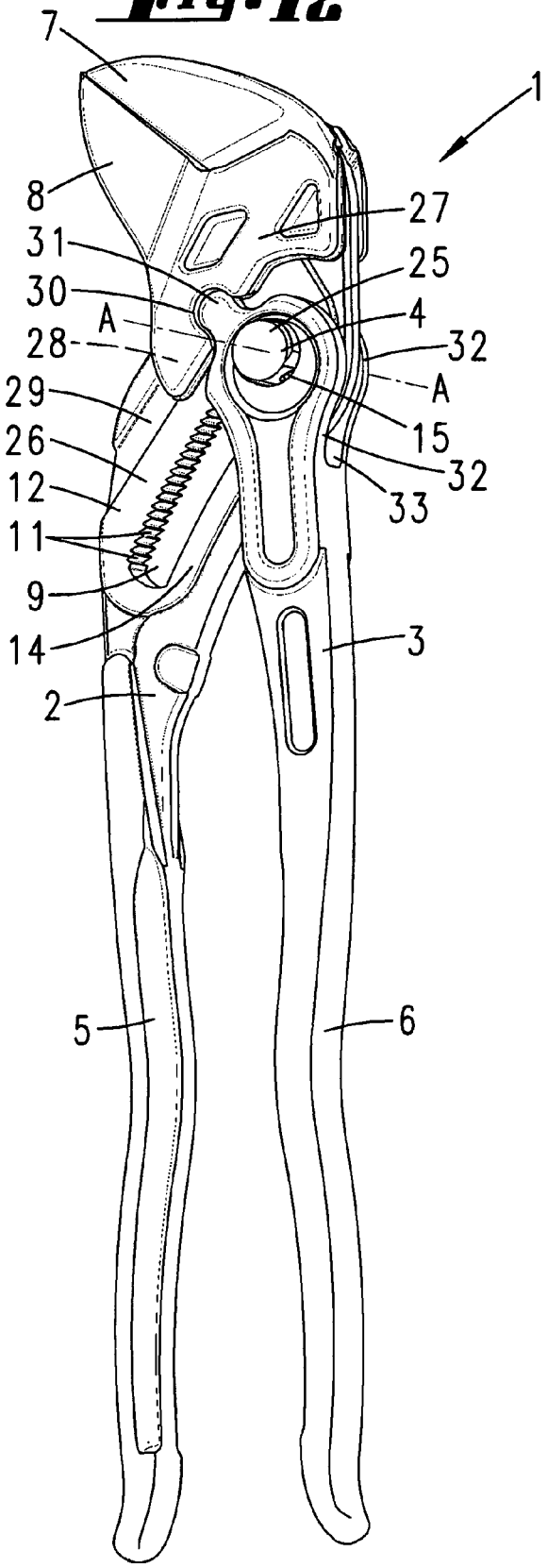
FIG. 12 shows the pliers in a perspective oblique view, for a second embodiment.
Figure 13:
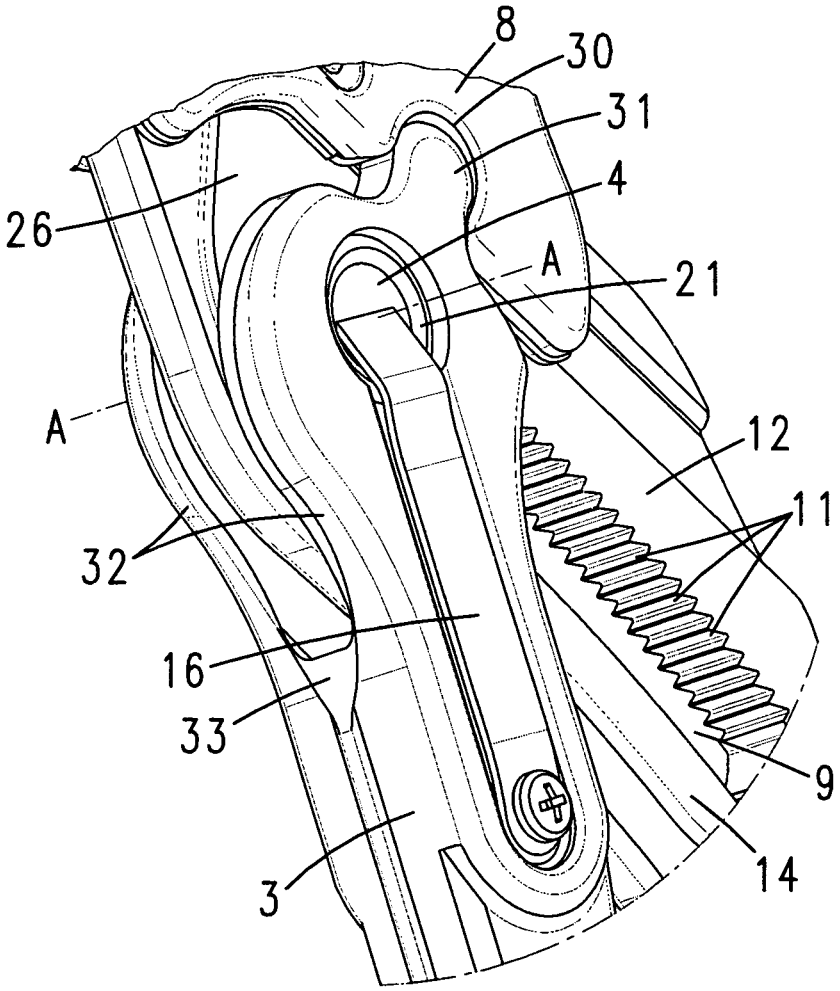
FIG. 13 shows a perspective representation of a detail, looking at the rear side of the pliers, for the rear, spring-loaded pin region.
Figure 14:
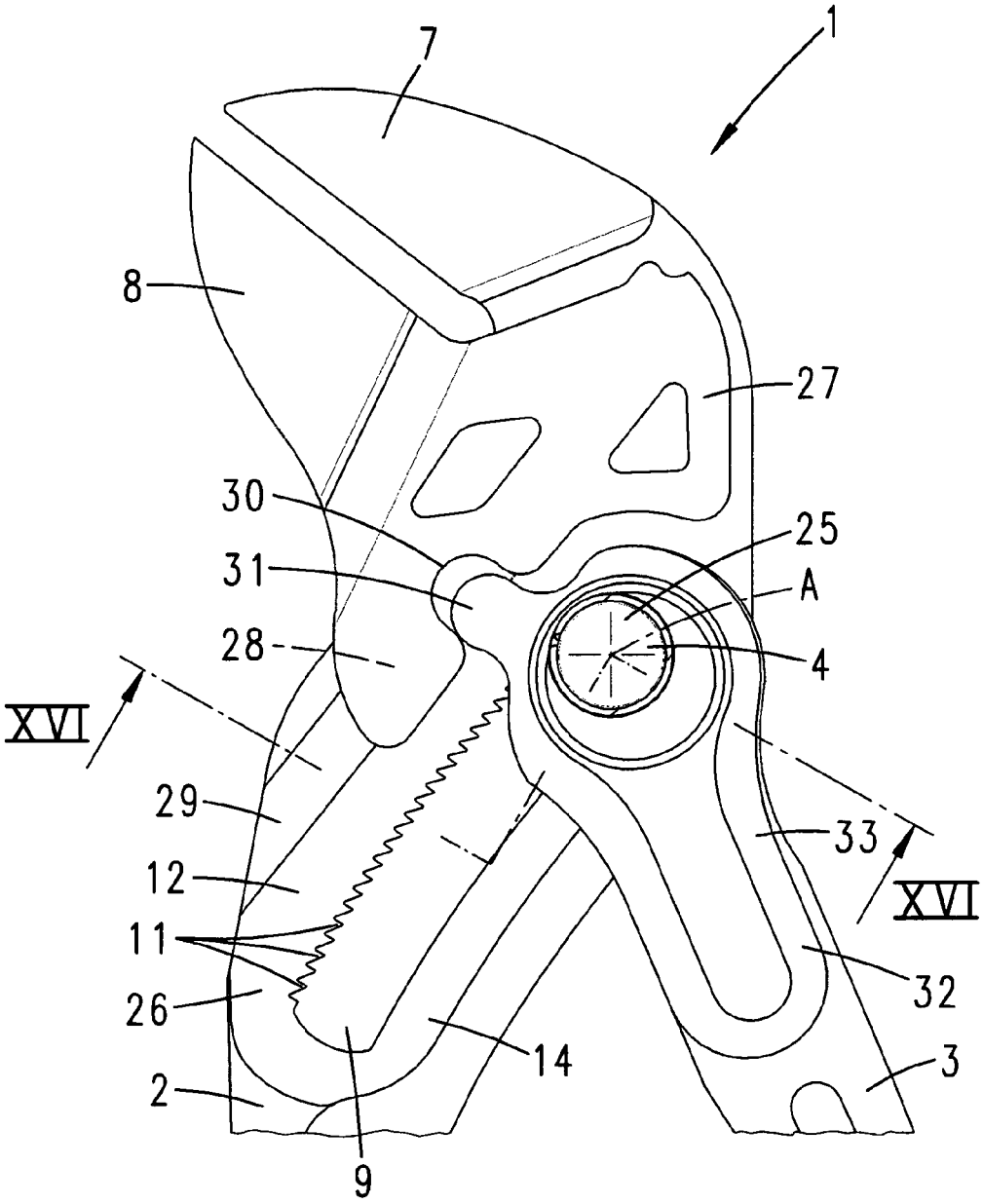
FIG. 14 shows the region of the pliers head in an enlarged representation when setting a small mouth opening width.
Figure 15:
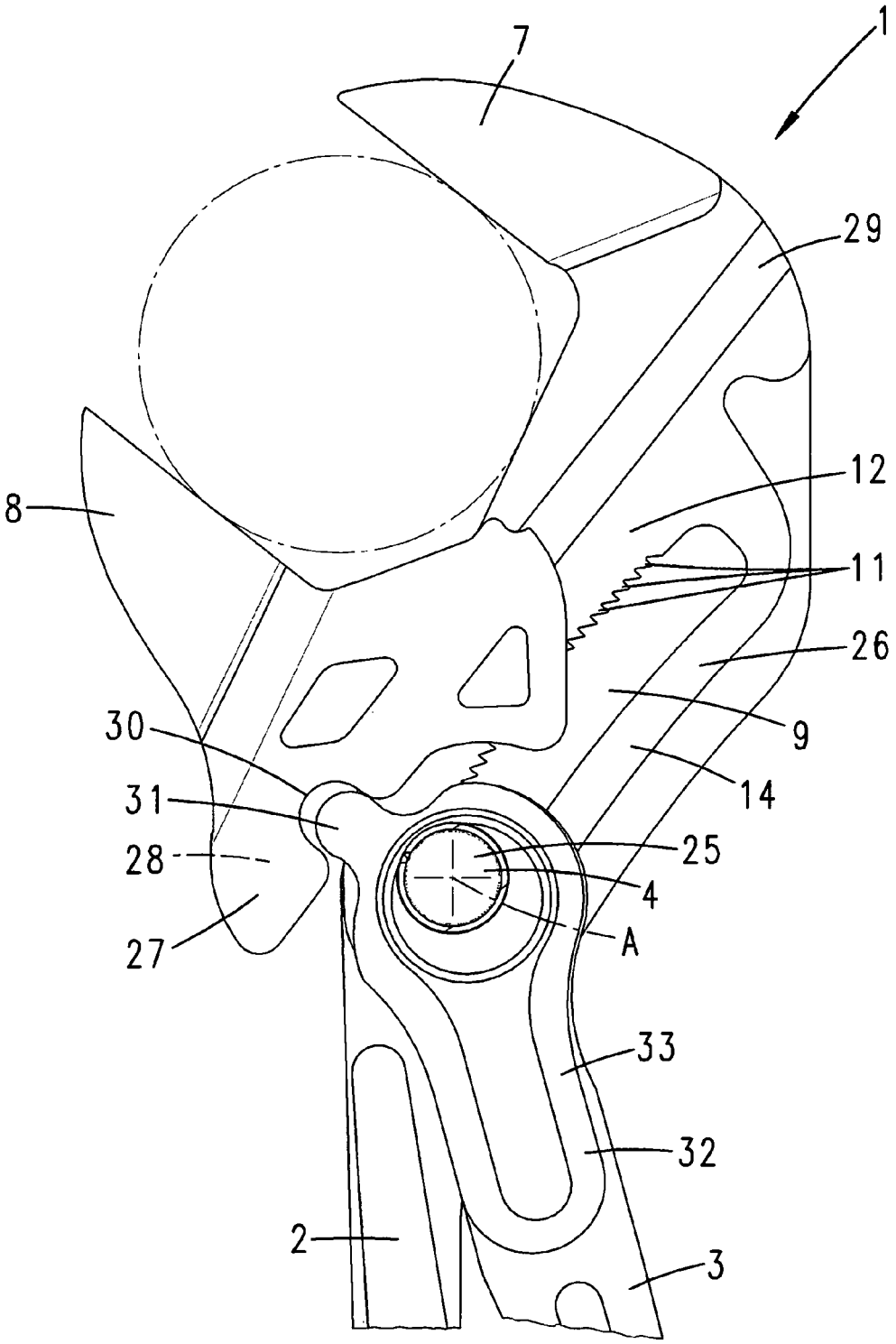
FIG. 15 shows a representation corresponding to FIG. 14, but after setting a large mouth opening width.
Figure 16:
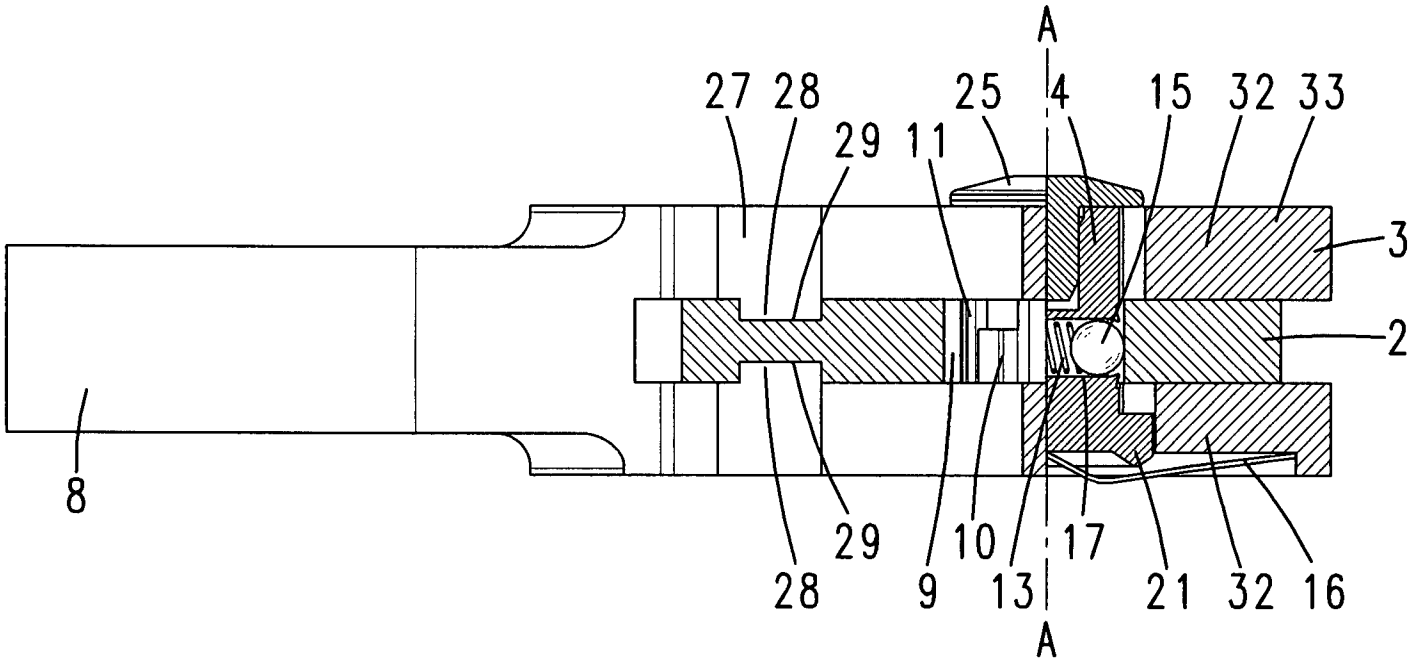
FIG. 16 shows the section along the line XVI-XVI in FIG. 14.
Figure 17:
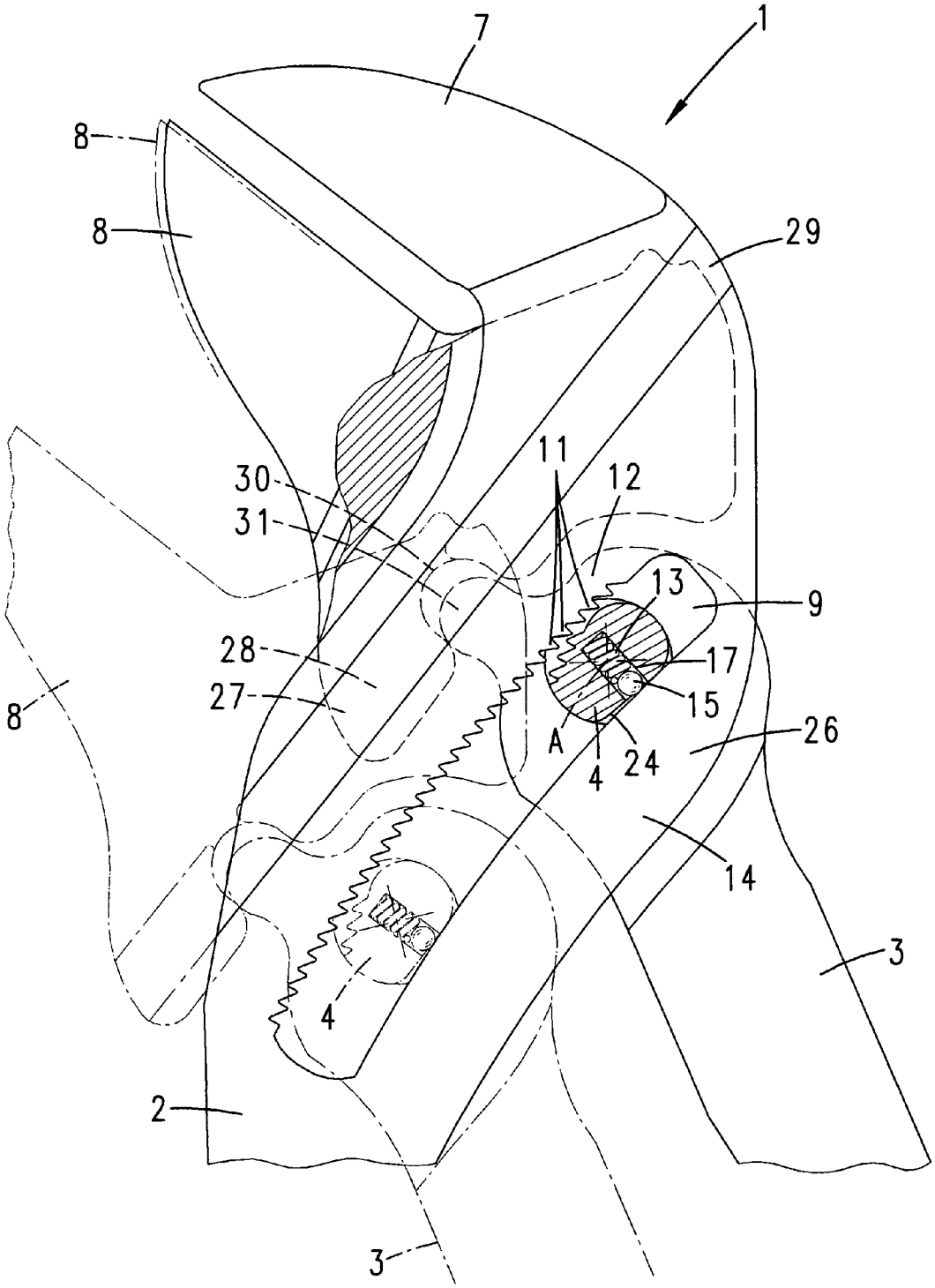
FIG. 17 shows a cross-section through the pliers according to the representation in FIG. 5, for the pliers of the second embodiment.

As revealed by FIG. 11, the opposite side, on which the engaging teeth 10 are formed in the lower region, is furthermore of a rounded form away from the engaging teeth 10 in the cross-section represented. The engaging teeth 10 are formed offset into said cross-section, with reference to a longitudinal axis or center line of the longitudinal slot 9, to the side away from the mouth. They are accordingly formed to face away from the mouth with respect to a longitudinal axis of the bore 17. In connection with the ball 15, an advantageous behavior is therefore also obtained, in a manner corresponding to a tilting moment, with which the disengagement of the pivot pin 4 can be achieved by virtue of pulling actuation, in the direction away from the mouth, of the movable pliers leg 3 in relation to the fixed pliers leg 2, which is thus notionally fixedly secured.

The engaging teeth 10 extend over a height of the pivot pin 4 that corresponds approximately to 1.5 times the height of the base 21 or to 20% to 35%, preferably approximately 25% to 30%, of the height H of the pivot pin 4.

Altogether, three engaging teeth 10 are actually provided in the case of the exemplary embodiment. The roots of the teeth lie on a line extending in the manner of a secant with respect to the diameter of the base 21.

Disposed on the upper side of the pivot pin 4 is a button part 25, which is moreover secured by way of a central stud in a bore in the pivot pin. The button 25, the outside diameter of which is somewhat smaller than the outside diameter of the base 21, protrudes over the area 24, and the opposite area, in the manner of a roof.

FIGS. 12 to 17 show a pair of pliers 1 in a second embodiment of the pliers wrench kind. Such a pliers wrench is known, for example, from EP 0 421 107 B1. The content of this patent specification is hereby incorporated in full into the disclosure of the present invention, including for the purpose of incorporating features of this patent in claims of the present invention.

The pliers wrench 1 likewise has a movable pliers leg 3 and a fixed leg 2, which latter merges integrally with a bearing plate 26. A longitudinal slot 9, formed in a way corresponding to the first exemplary embodiment, is formed in this bearing plate 26. Said slot has on its longitudinal flank 12 facing the pliers mouth counter teeth 11, for interaction with engaging teeth 10 of a pivot pin 4 connecting the movable leg 3 to the fixed leg 2.

The configuration of the counter teeth 11, in particular the alignment of the tooth flanks, is chosen to be the same as that of the first exemplary embodiment.

In the region remote from the gripping portion 5 of the fixed pliers leg 2, a fixed jaw 7 of thicker material in comparison with the bearing plate 26 is disposed. Lying opposite this fixed jaw 7 is a movable jaw 8, which is substantially foldingly symmetrical to the fixed jaw 7. The movable jaw 8 forms in its lower region two extension arms 27, which rest on the surfaces of the bearing plate 26, reach over the latter in their upper region and carry guiding portions 28 on the inner side facing the bearing plate 26. These extension arms engage in guiding grooves 29 machined in both opposite surfaces of the bearing plate 26 above the longitudinal slot 9, i.e. facing the pliers mouth, which guiding grooves 29 extend in a straight line parallel to a linear connecting line between the end points of the longitudinal slot 9. Accordingly, the movable pliers jaw 8 is linearly displaceable on the bearing plate 26 in the direction of the fixed jaw 7 or away from it.

Facing the longitudinal slot 9, the movable pliers jaw 8 is provided on both sides of the bearing plate 26 with substantially U-shaped pivot recesses 30. These are open toward the longitudinal slot 9. They serve for receiving pivot spigots 31 and the pivot spigots 31 protrude radially outward from leg end portions 32 of the movable pliers leg 3 engaging the pivot pin 4, which leg end portions 32 are formed at the end of the movable pliers leg 3 in the region of a fork portion 33 on both sides of the bearing plate 26.

The movable pliers leg 3 is pivotably displaceable about the pivot axis A defined by the pivot pin 4. By pivoting displacement, the movable pliers jaw 8 is moved in a linearly guided manner in the direction of the fixed jaw 7 as a result of the displacement of the pivot spigots 31 on a path over a portion of a circle.

The pivot pin 4 of the pliers 1 according to a second embodiment is configured in the same way as that of the embodiment described above. Accordingly, reference is made to the first exemplary embodiment with respect to the configuration of the tooth formation and the configuration of the pivot pin as such.

Here, too, possibilities for adjustment in two respects are obtained; to be specific, on the one hand that which is conventional in principle, by pressing down the pivot pin 4 in the direction of the pivot axis A counter to the force of the spring 16 acting rearwardly on the pivot pin 4.

On the other hand, here, too, the pivot pin 4 can be adjusted by merely displacing the pliers legs 2 and 3 in relation to one another in the plane described. Simply by pulling loading of the movable pliers leg, the pivot pin 4 is brought out of the interlocking engagement with the tooth formation of the longitudinal slot 9. So it is also possible here for an adjustment of the mouth width, i.e. the spacing between the pliers jaws 7 and 8, to be carried out without manipulation of the pivot pin 4.

FIGS. 18 to 22 show the pliers 1 in a further embodiment of the water pump pliers kind, which is of substantially the same construction as the first exemplary embodiment described with reference to FIG. 1 et seq.

So, two pliers legs 2 and 3, which cross at the pivot pin 4, are also provided here. The pliers leg 2 is a fixed pliers leg, in relation to which the pliers leg 3 is movable, for changing the mouth width.

In this embodiment too, the movable pliers leg is fork-shaped in the crossing region, for flanking both sides of the fixed leg portion having the longitudinal slot 9. The pivot pin 4 is pivotably held in the fork portions of the movable leg 3.

The radially outwardly directed engaging teeth 10 of the pivot pin 4 interact with counter teeth 11, disposed in the longitudinal slot 9 along an associated flank 12, for fixing the movable pliers leg 3 against sliding.

The interlocking engagement of the pivot pin 4 with respect to the tooth formation of the longitudinal slot is also assisted by a spring 13 acting on the pin 4, which spring 13 is supported, indirectly with a ball 15 interposed, on the flank 14 of the longitudinal slot 9 lying opposite the tooth formation of the longitudinal slot.

To offer a possibility of overcoming the interlocking engagement between the pivot pin 4 and the counter tooth formation 11, without directly actuating the pivot pin 4 by pressing actuation and displacement of the same along the pivot axis A, in the embodiment represented in FIGS. 18 to 22, the pivot pin is provided, in a cross-section in the plane or family of planes defined by the longitudinal slot 9, with an actuating projection 34. For this purpose, the pivot pin 4 is substantially trapezoidally-shaped in this plane, with two longitudinal sides 24 and 35 of the trapezoid directed parallel to one another. The center axis of the bore 17 accommodating the spring 13 and the ball 15 is substantially perpendicular to the surfaces of the longitudinal sides 24 and 35. As per the first exemplary embodiment, the ball 15 emerges from the area 24.

The planar area 35 of the trapezoid extends in cross-section approximately from the center axis of the bore 17 outward, while reaching over the preferably circular base 21 of the pivot pin 4, doing so with a protrusion dimension that corresponds approximately to the diameter dimension of the ball 15. At the end, the longitudinal side 35 of the trapezoid merges with a narrow side 22 of the trapezoid, approximately enclosing an angle of 60° in relation to the longitudinal side 35 of the trapezoid, said narrow side in turn running into the opposite longitudinal side 24 that is aligned parallel to the longitudinal side 35 of the trapezoid.

The transition region from the longitudinal side 35 to the narrow side 22 is rounded, to form the actuating projection 34. In a projection onto the bore 19 or 19' of the movable pliers leg 3, the said actuating projection accordingly protrudes beyond the periphery of the bore into the free space of the longitudinal slot 9.

Away from the actuating projection 34, the longitudinal side 35 of the trapezoid merges with the engaging tooth formation, which engaging teeth 10 are positioned on a plane directed perpendicularly in relation to the pivoting plane of the pivot pin 4, which plane in cross-section encloses an obtuse angle in relation to the longitudinal side 35, furthermore approximately an angle of 165°.

The actuating projection 34 is directed in the direction of the base flank 36 of the longitudinal slot associated with the pliers head. This base flank 36 extends transversely in relation to the longitudinal flanks 12 and 14 of the longitudinal slot 9.

The transition regions, in particular the transition region from the base flank 36 to the flank 12 having the counter teeth 11, are highly rounded, to form a control cam 37.

Figure 18:
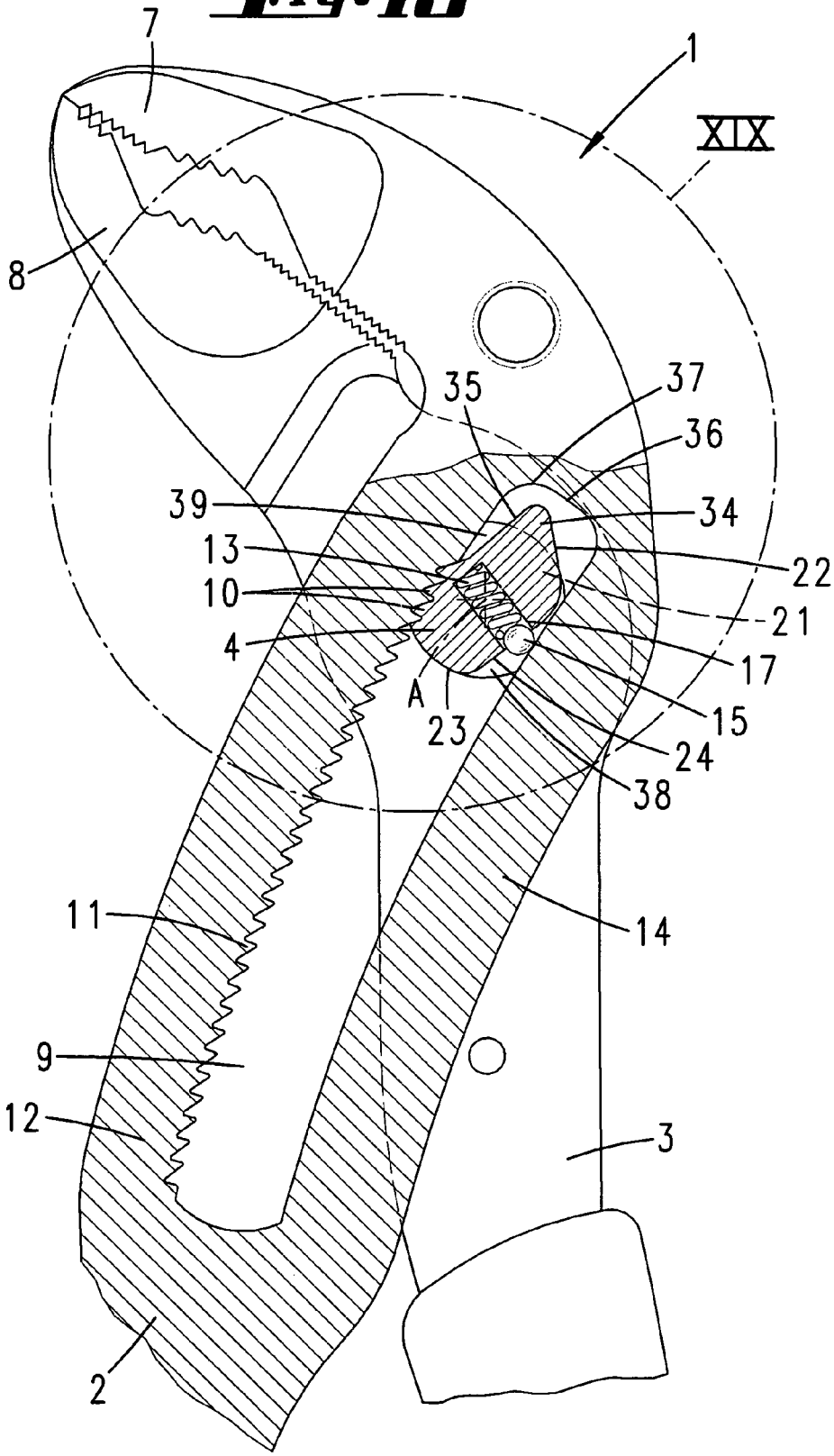
FIG. 18 shows the pliers head in a further embodiment, with a pivot pin having an actuating projection, for the closed position of the pliers mouth.

The arrangement is further chosen such that, in an interlocking position according to the representation in FIG. 18, an interstitial free space 38, 39 is respectively established between the longitudinal area 24 of the trapezoid and the associated flank 14 of the longitudinal slot 9 and also between the longitudinal side 35 of the trapezoid and the facing flank 12 of the longitudinal slot 9, the free space having a respective included angle of approximately 15°.

In this basic position, the actuating projection 34 is disposed off-center and facing the flank 12 with respect to a longitudinal center axis of the longitudinal slot 9, the axis crossing the pivot axis A of the pivot pin 4.

Furthermore, when considered in the longitudinal direction of the longitudinal slot 9, the pivot pin 4 is formed, on both sides of the bore 17 accommodating the spring 13 and the ball 15, with a width G, which is less than the width B of the longitudinal slot 9 at least by approximately the extent of the tooth engagement. In actual fact, furthermore, the width G' of the pivot pin 4 in the region of the longitudinal slot 9 on the mouth side of the bore 17 is reduced with respect to the width dimension G by the height dimension of the engaging teeth 10, when considered transversely in relation to the extent of the longitudinal slot.

Figure 20:
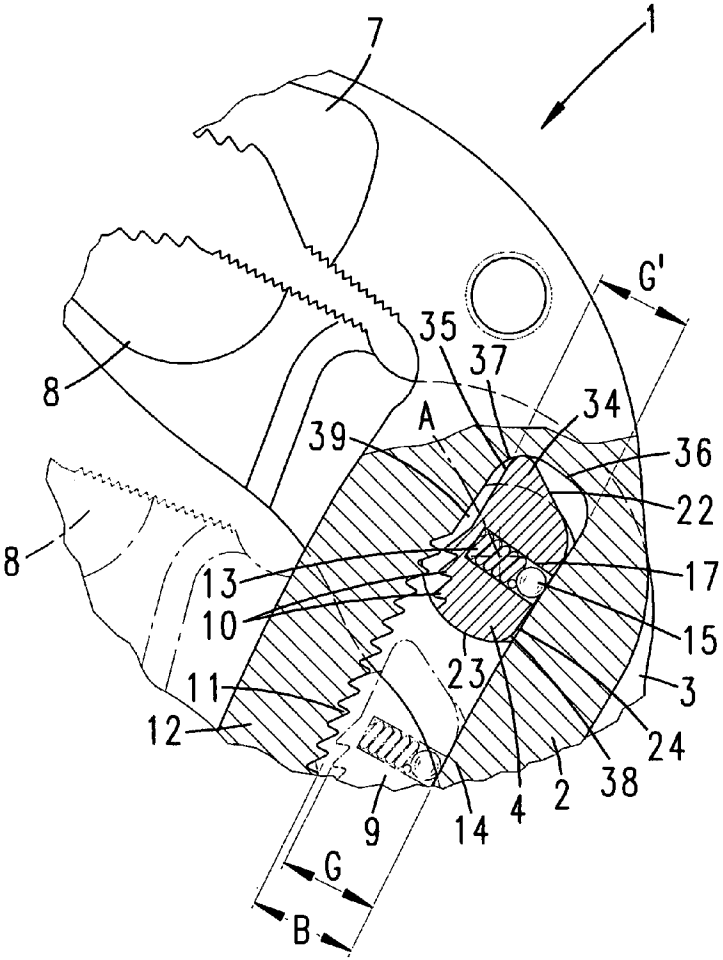
FIG. 20 shows a representation corresponding to FIG. 19, but for the position when the interlocking engagement is released.
Figure 19:
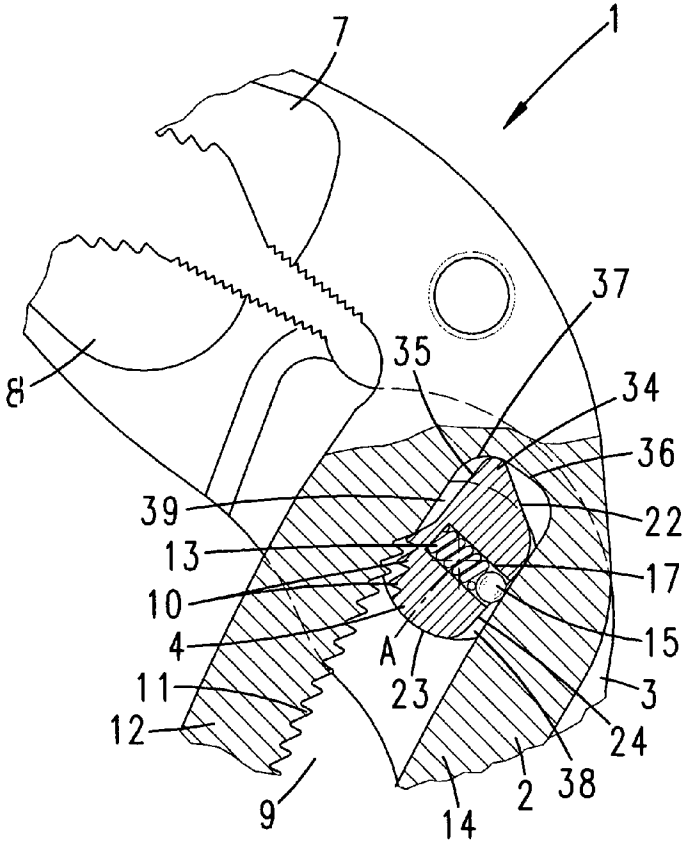
FIG. 19 shows the enlargement of the region XIX taken from FIG. 18, but in the course of overcoming the locking between the pivot pin and the pliers leg.
Figure 21:
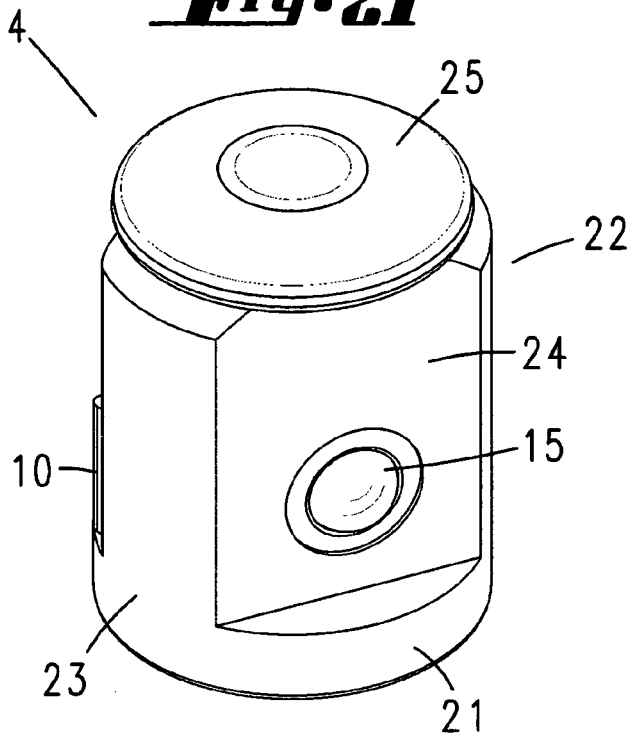
FIG. 21 shows a perspective representation of the pivot pin according to the embodiment in FIGS. 18 to 20.
Figure 22:
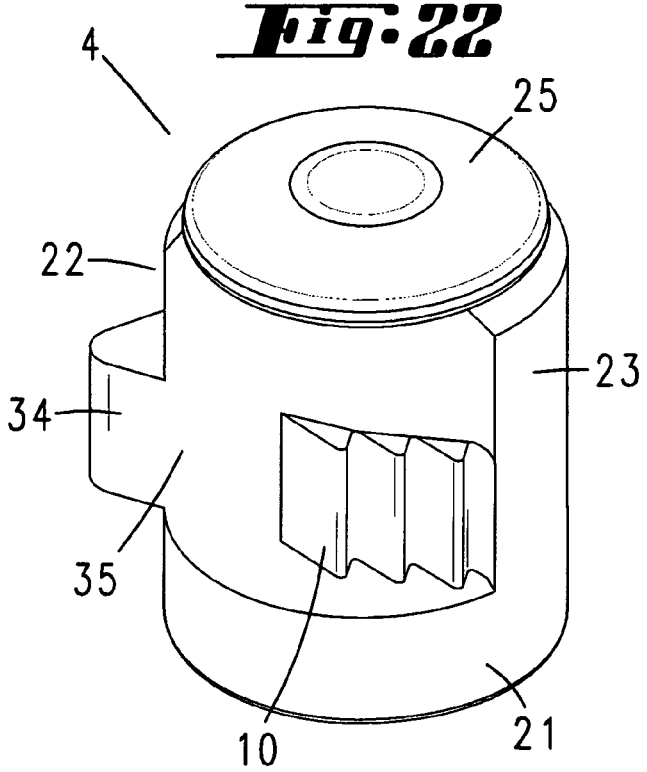
FIG. 22 shows a further perspective representation of the pivot pin.

As can be gathered from FIGS. 19 and 20, the pivot pin 4 can be released from the interlock merely by pulling loading of the movable pliers leg 3 in the direction of the longitudinal extent of the longitudinal slot 9, this occurring from a minimal mouth width position according to FIG. 18, in which the engaging teeth 10 of the pivot pin 4 engage in the final counter teeth 11 of the longitudinal slot 9 when considered with respect to the base flank 36. As already described in the previous exemplary embodiments, this position can also be reached from a different mouth width position by ratchet-like displacement. By further pulling-loaded displacement of the pivot pin 4 in the direction of the base flank 36—possibly with simultaneous pivoting displacement, by a few angular degrees, of the movable pliers leg 3 in the direction of a mouth opening position—the actuating projection 34, which is off-centre with respect to the longitudinal center axis of the longitudinal slot 9, butts against the base flank 36 of the longitudinal slot 9, which brings about a directionally controlled, forced rotational displacement of the pivot pin 4 on account of the rounded contour of the actuating projection 34 and the off-center arrangement thereof, while furthermore the control cam 37 further assists this forced rotational displacement. With reference to the representations in FIGS. 18 to 20, a counterclockwise rotational displacement thereby takes place about the pivot axis A. Pressing-in of the ball 15 counter to the force of the compression spring 13 causes the longitudinal area 24 of the trapezoid to pivot in the direction of the associated flank 14 of the longitudinal slot 9, finishing up in abutment on said flank. In this position, the opposite engaging teeth 10 have moved out of the counter teeth 11 of the longitudinal slot 9. The supporting of the actuating projection 34 on the base flank 36 of the longitudinal slot 9 has the effect that, while the loading is maintained by way of the movable pliers leg 3, a turning moment is imparted to the pivot pin 4 in the direction of overcoming the interlock.

While maintaining a pulling force on the pivot pin 4, directed transversely in relation to the longitudinal extent of the longitudinal slot 9, by way of the movable pliers leg 3, said pivot pin remains in the abutment position of the area 24 of the trapezoid on the associated flank 14 of the longitudinal slot according to FIG. 20, so that a setting of the mouth width, in particular an enlargement of the mouth width, can be achieved by sliding displacement of the pliers leg 3.

The proposed solution according to the embodiment in FIGS. 18 to 22 may be used both in conjunction with a pivot pin 4 which is displaceable along the pivot axis A (by means of which displacement an alternative way of overcoming the interlock can be achieved) and with a pivot pin 4 which is not displaceable in this form. In the latter case, overcoming of the interlock can accordingly be achieved only by turning the pivot pin with interaction between the actuating projection 34 and the associated flank of the longitudinal slot 9.

Figure 23:
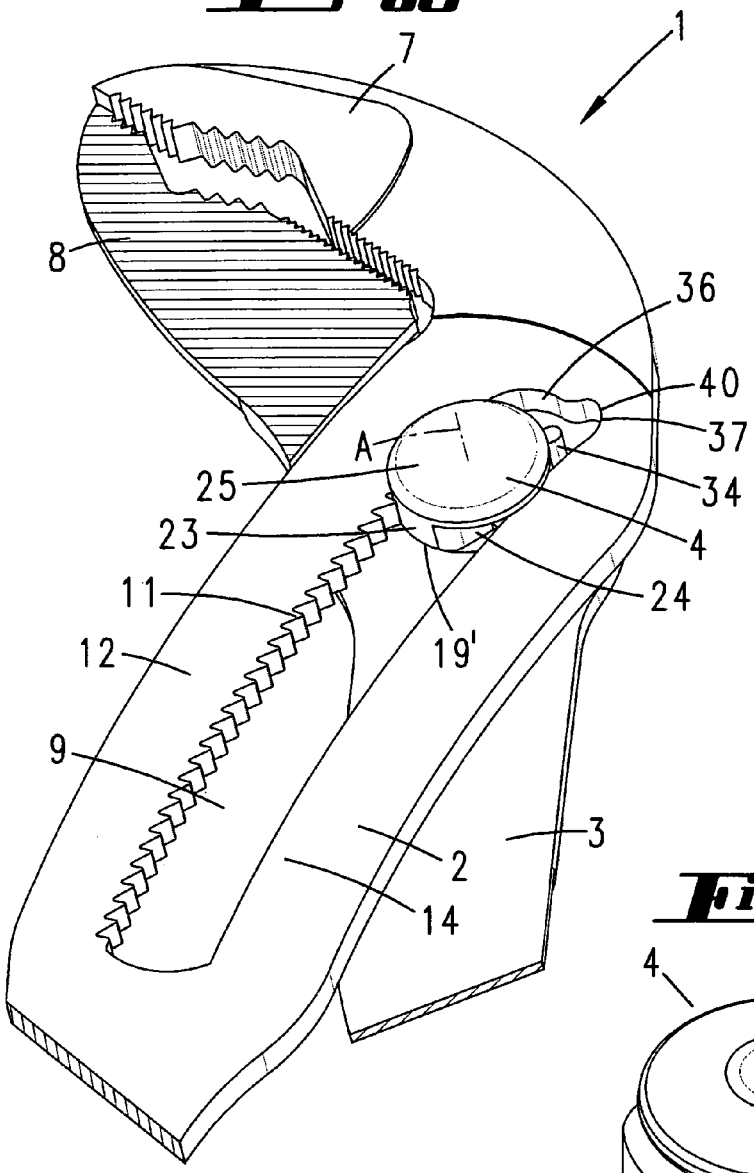
FIG. 23 shows in a perspective, partially sectional representation, the pliers head in a further embodiment, likewise with a pivot pin having an actuating projection.
Figure 24:
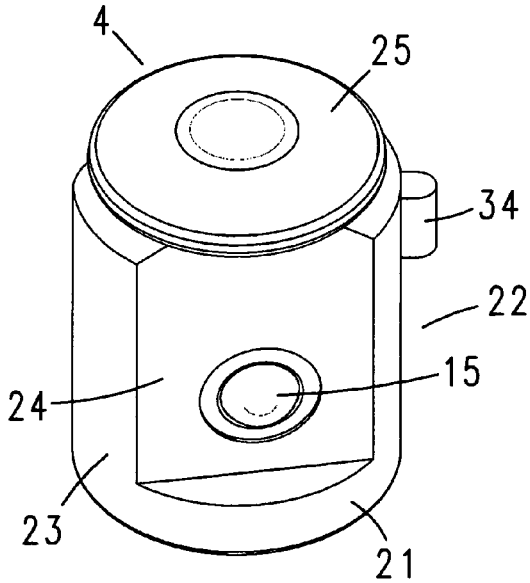
FIG. 24 shows a perspective representation of an alternative pivot pin, as compared with the pivot pin represented in FIG. 23, on its own, said alternative pivot pin being displaceable in a sliding manner in the direction of its pivot axis.
Figure 25:
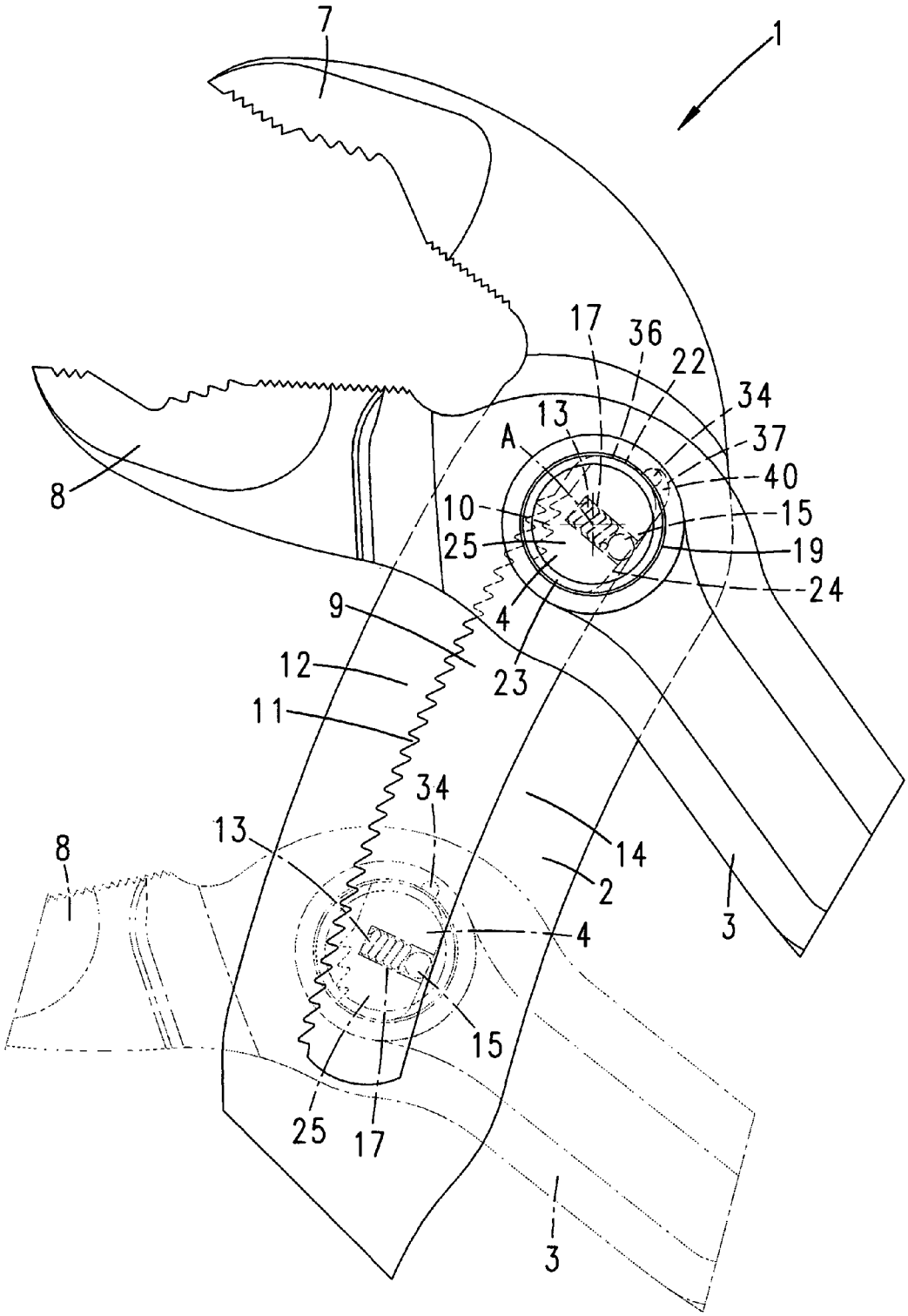
FIG. 25 shows the region of the pliers head of the embodiment according to FIG. 24, when overcoming the interlocking engagement.

FIGS. 23 to 25 show an alternative configuration of this embodiment, a pivot pin 4 which cannot be displaced in the direction of the pivot axis A being provided in FIGS. 23 and 25. In this embodiment, the pivot pin 4 is provided in a cross-section in a plane of the longitudinal slot, starting from a narrow side 22 of the trapezoid having the base contour, with a spigot-like actuating projection 34, extending in the direction of the base flank 36 of the longitudinal slot 9. This actuating projection also extends off-center with respect to a longitudinal center axis of the longitudinal slot 9, here facing the flank 14 opposite the counter teeth 11.

The transition region from the flank 14 to the base flank 36 is provided with a recess 40, forming a control cam 37.

In the interlocking engagement situation, the actuating projection 34 is supported on the mouth side of the pivot pin bore 17 on the associated flank 14 of the longitudinal slot. In the course of a displacement of the movable pliers leg 3 in the direction of a minimal mouth width position according to the representation in FIG. 23, the actuating projection 34 enters the control-cam-like recess 40, with the pivot pin 4 being displaced at the same time by way of the bores 19 and 19' of the leg, further pulling loading by way of the movable leg 3 in the direction of the longitudinal extent of the longitudinal slot 9 causing, by way of the control cam 37, a forced rotational displacement of the pivot pin 4 to be brought about in a way corresponding to the exemplary embodiment described above. Here, too, a counterclockwise forced rotational displacement of the pivot pin 4 takes place with respect to FIGS. 23 and 25, which makes the engaging teeth 10 leave the counter tooth formation in the longitudinal slot 9 (cf. FIG. 25). It is also possible in this embodiment for an adjustment of the mouth width to take place after the tooth engagement is overcome if pulling loading is maintained transversely in relation to the extent of the longitudinal slot 9 by way of the movable pliers leg 3 (cf. dash-dotted representation in FIG. 25).

The configuration described above may also be provided in conjunction with a pivot pin 4 which can be displaced along the pivot axis A in an alternative way of overcoming the interlock. A pivot pin 4 of this kind is represented in FIG. 24. In the case of sliding displacement of the pivot pin 4 to overcome the interlocking engagement, the actuating projection 34 retracts into the longitudinal slot 9.

Figure 26:
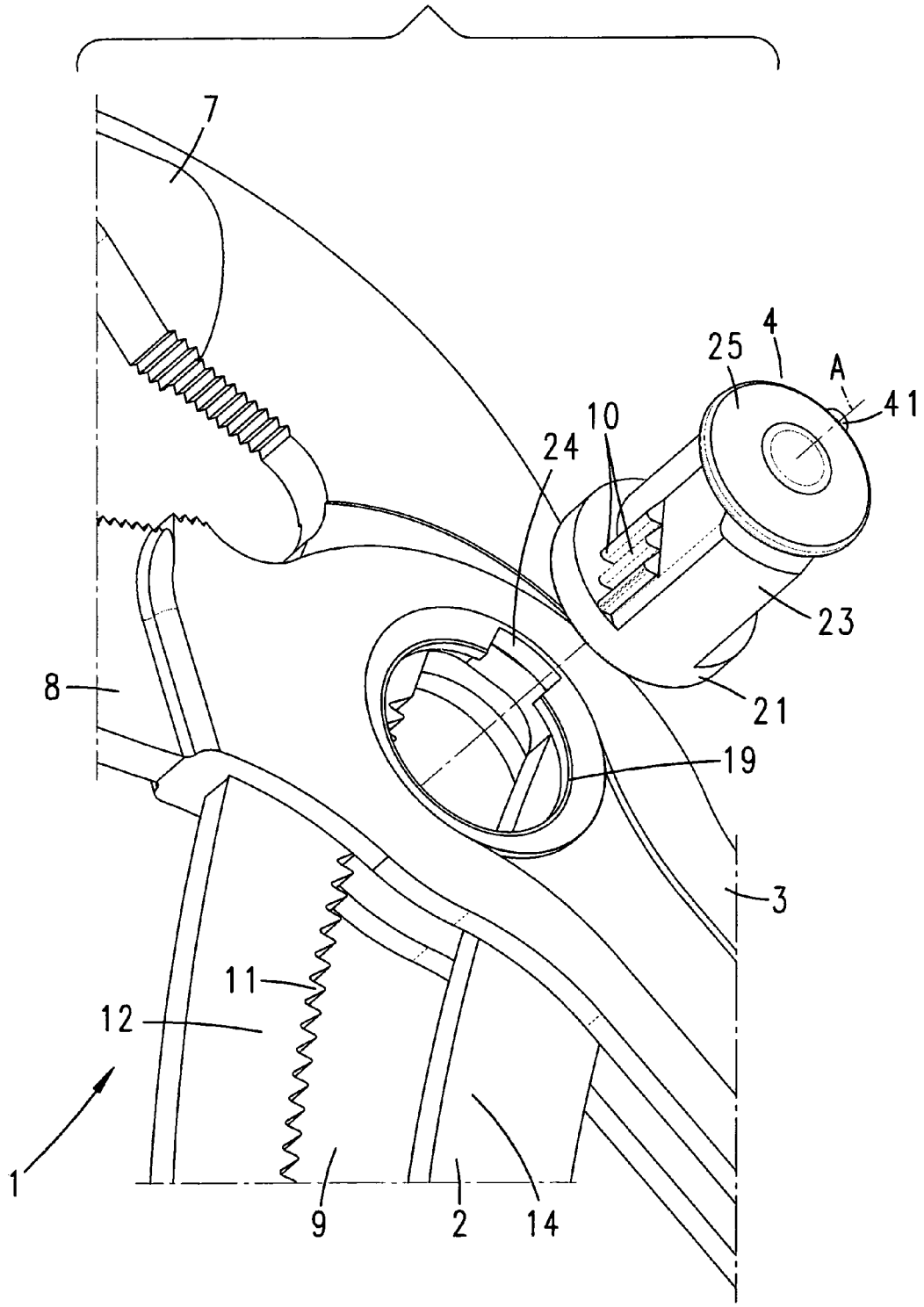
FIG. 26 shows a perspective partial representation of the region of the pliers head, a further embodiment with a pivot pin which is displaceable in the direction of the pivot axis.
Figure 27:
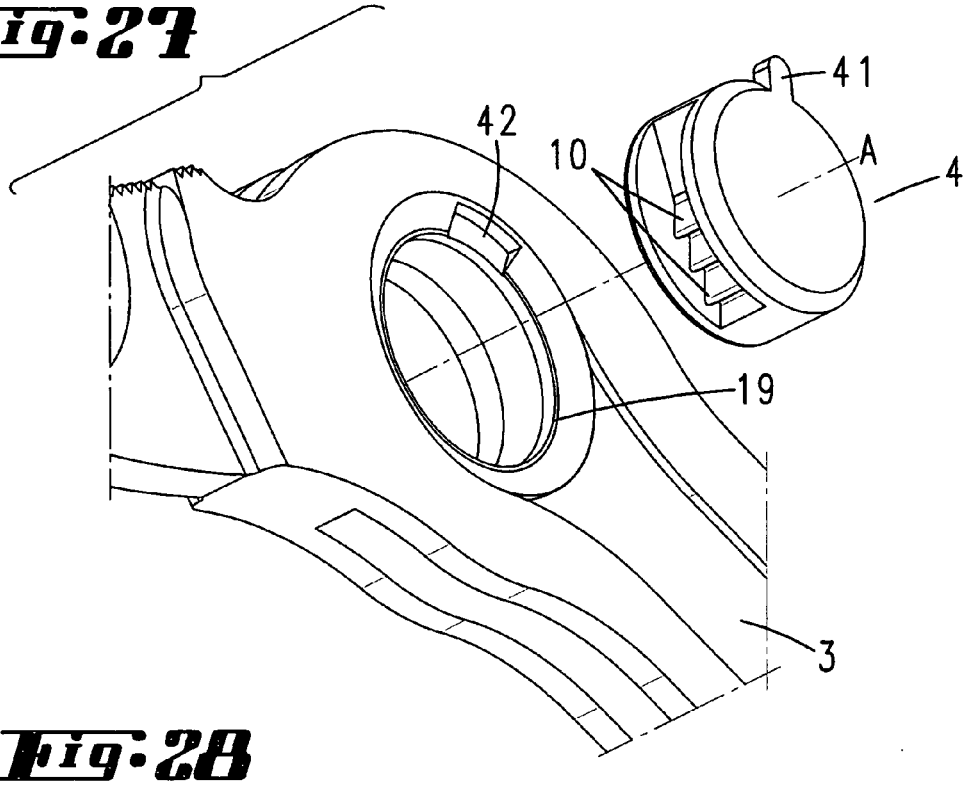
FIG. 27 shows a further perspective representation, but here merely of the region of the pliers head of the fixed pliers leg, with an alternative pivot pin that is not displaceable in a sliding manner.
Figure 28:
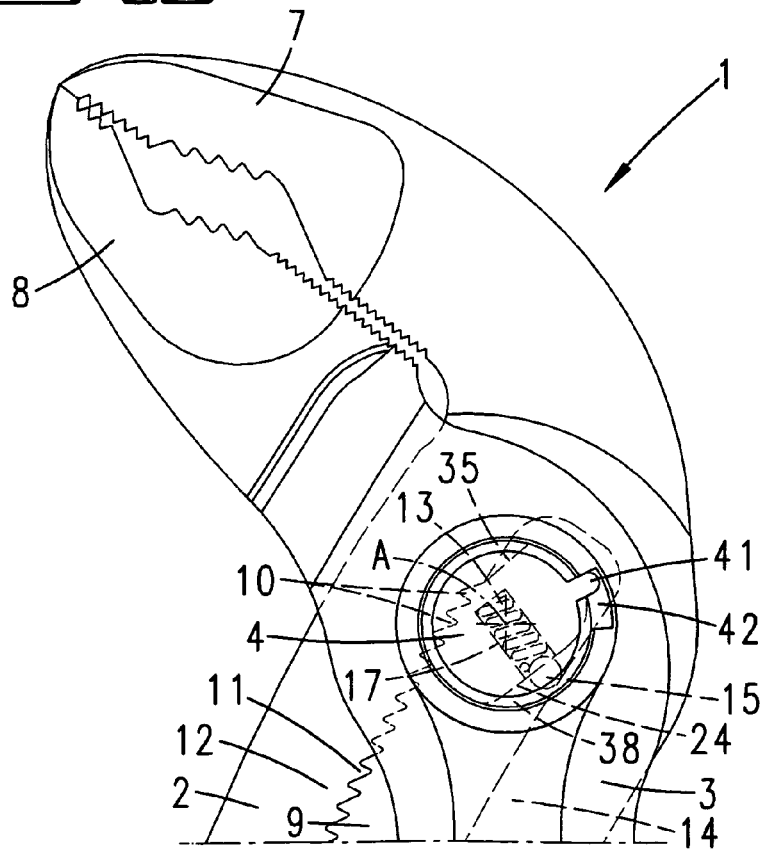
FIG. 28 shows the region of the pliers head with a pivot pin according to the representation in FIG. 27, for the engaging position of the tooth formation.
Figure 29:
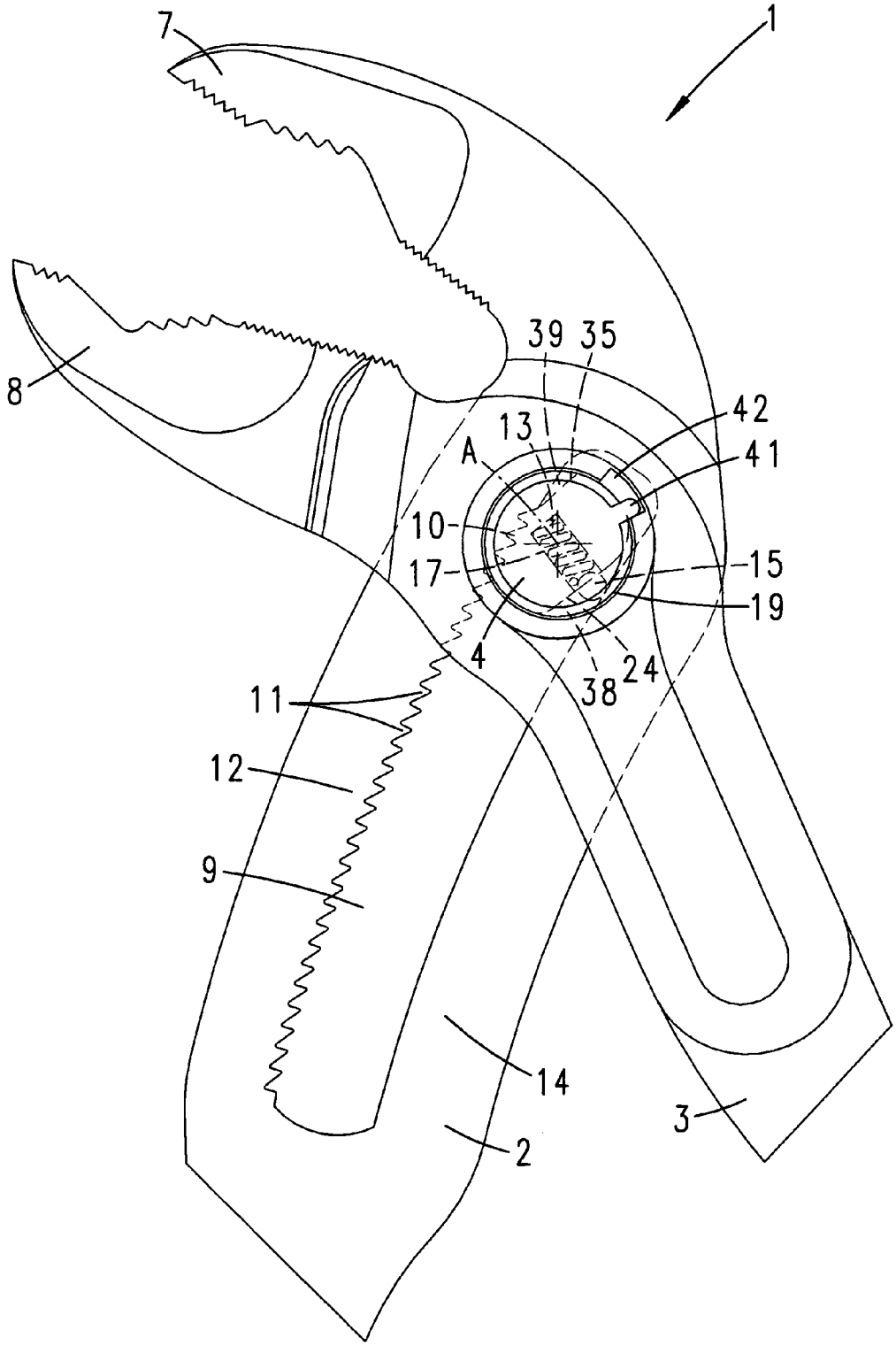
FIG. 29 shows the region of the pliers head in a pliers mouth opening position, also for the engaging position of the tooth formation.
Figure 30:
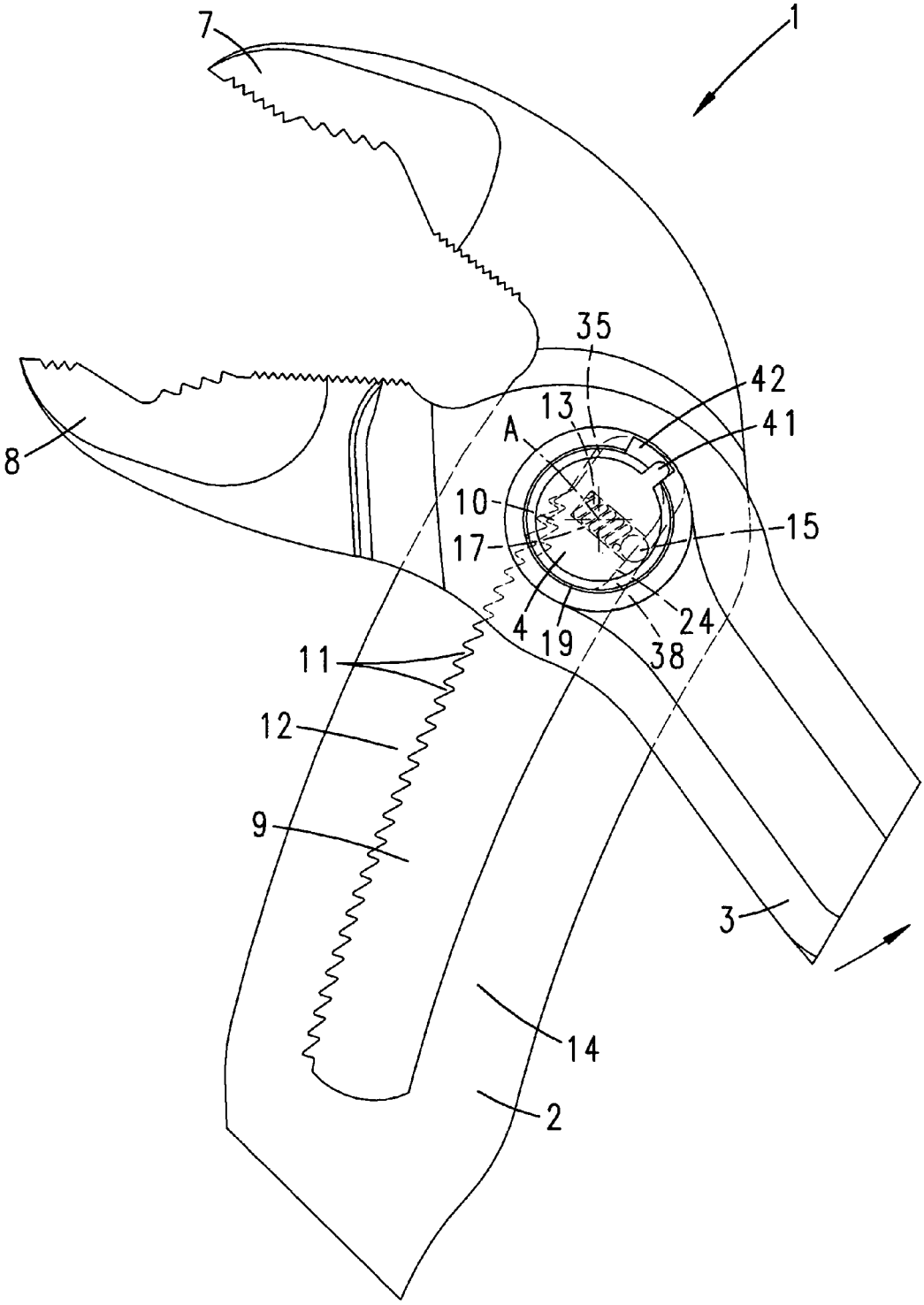
FIG. 30 shows an intermediate position in the course of overcoming the interlocking engagement when the movable pliers leg is pivoted further with respect to the fixed pliers leg.
Figure 31:
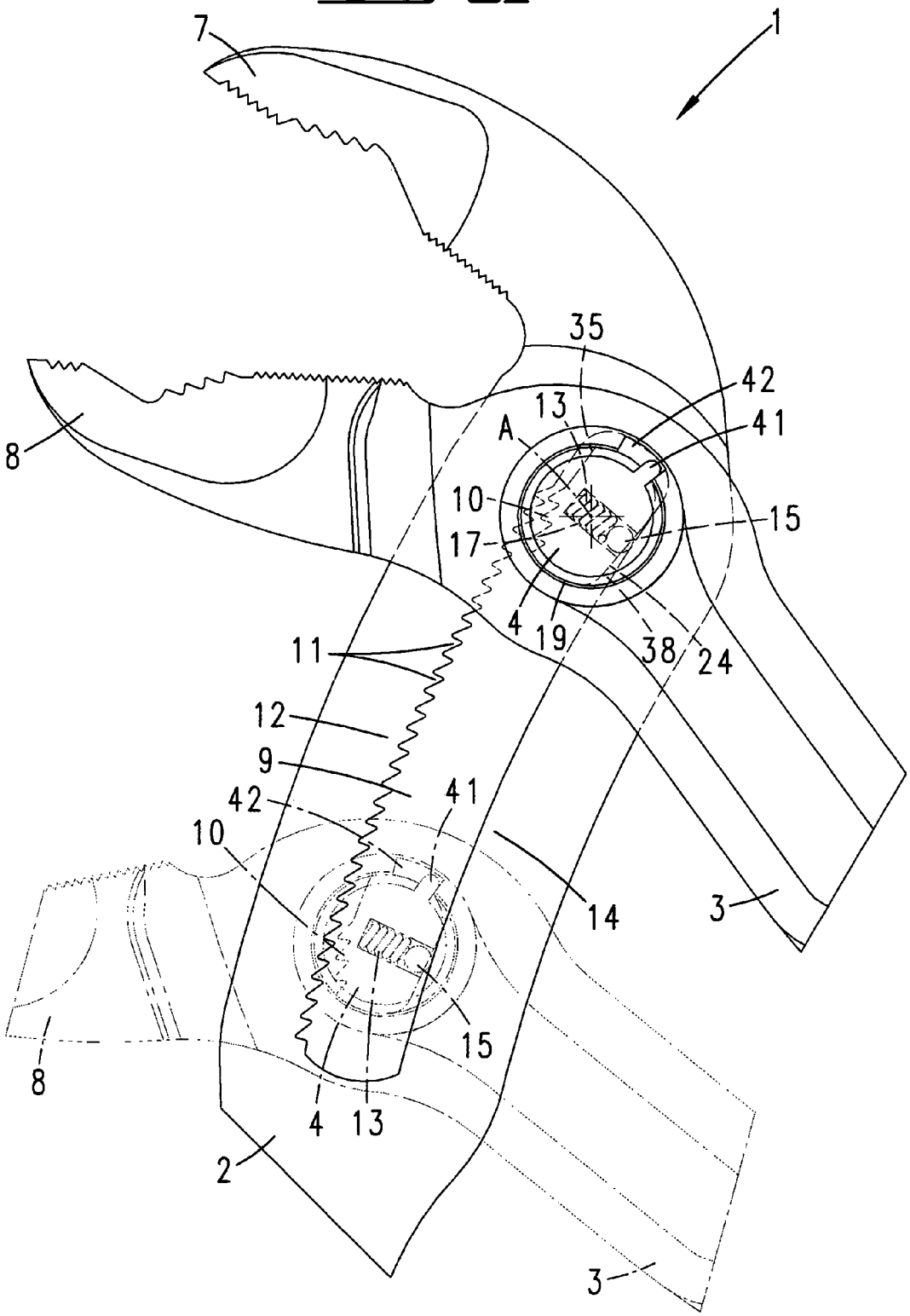
FIG. 31 shows a representation following on from FIG. 30, but for the overcome position of the interlocking engagement.
Figure 32:
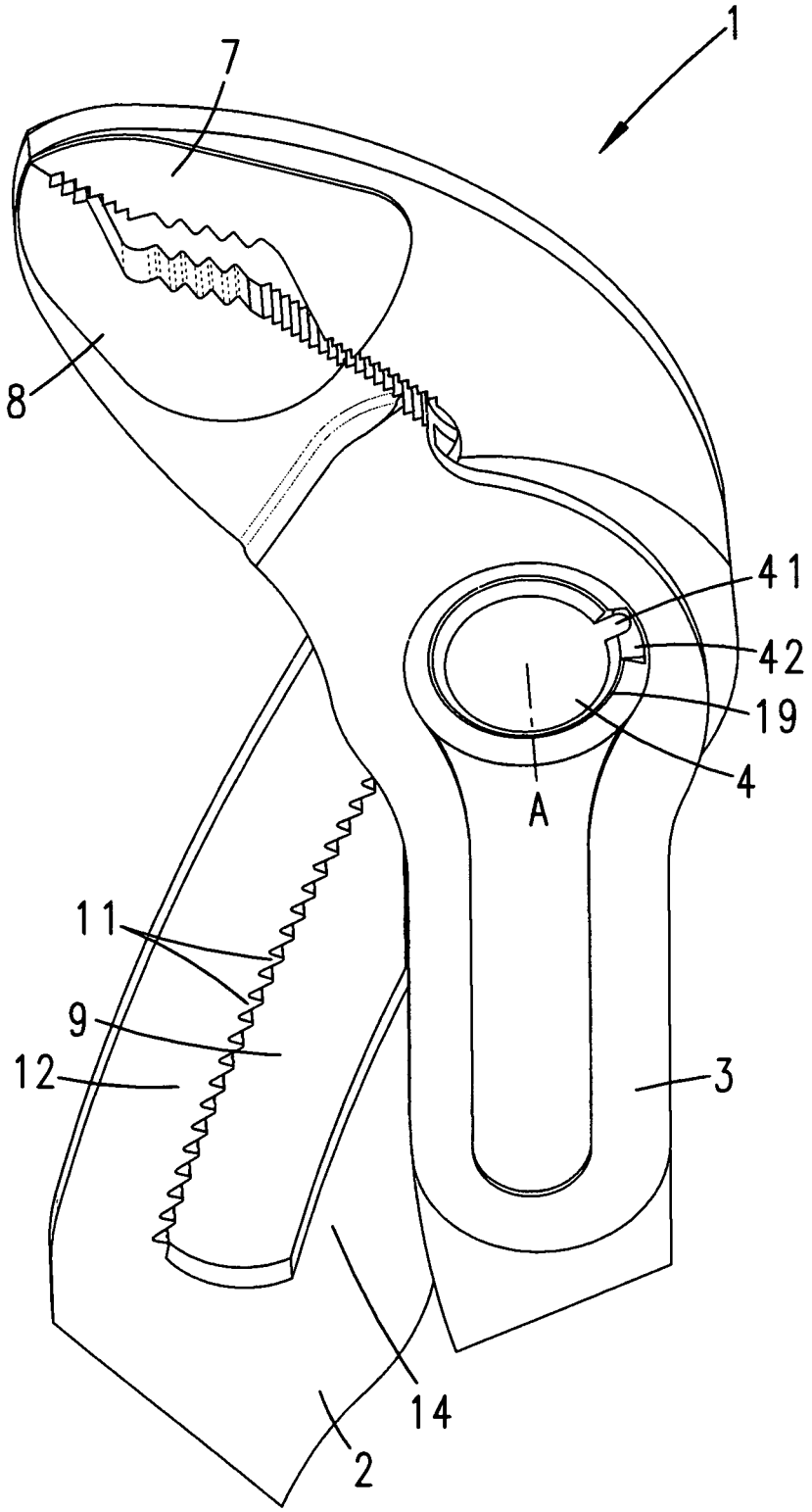
FIG. 32 shows a further perspective representation of the embodiment according to the representations in FIGS. 26 to 31.
Figure 33:
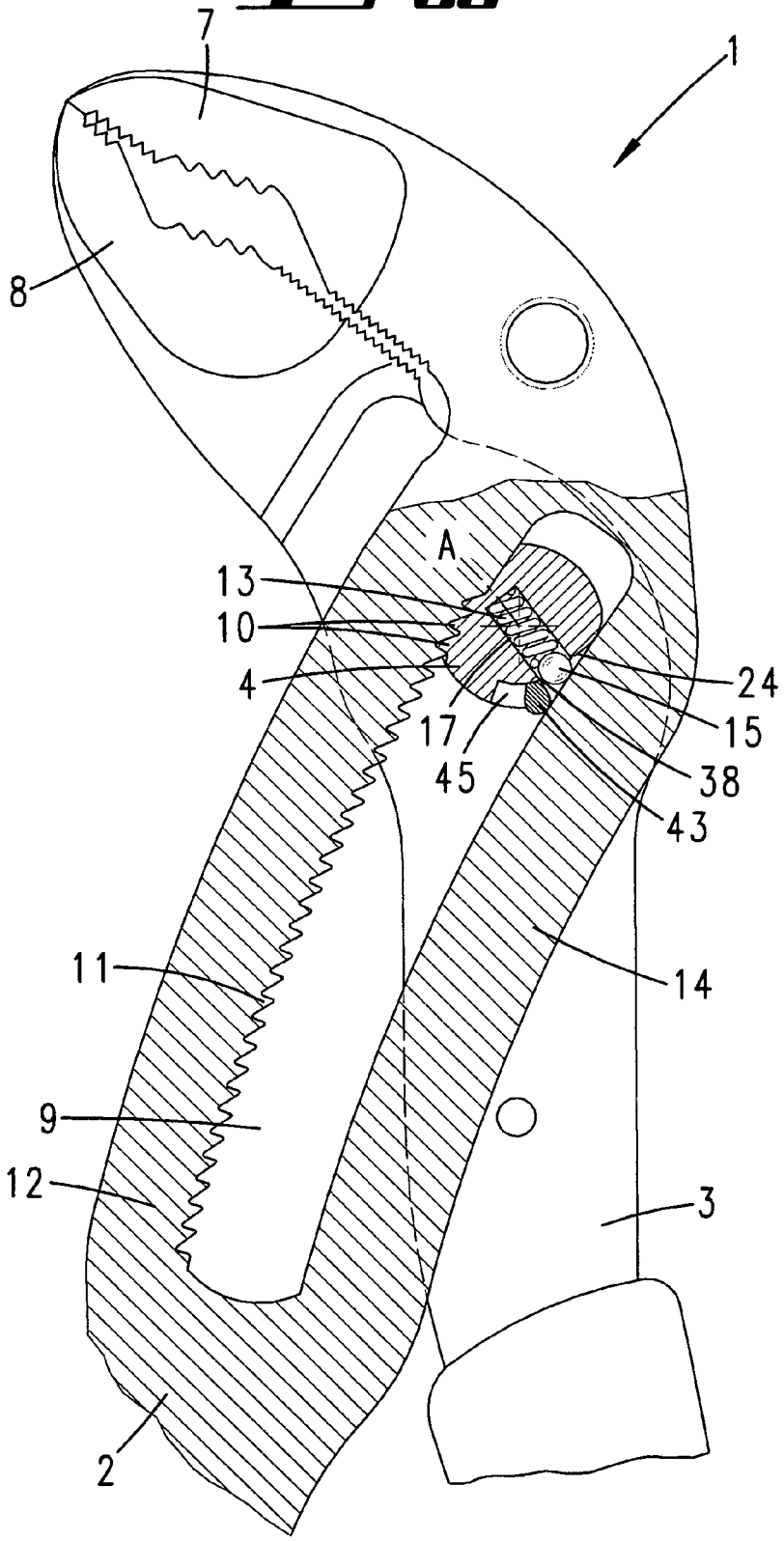
Figure 34:
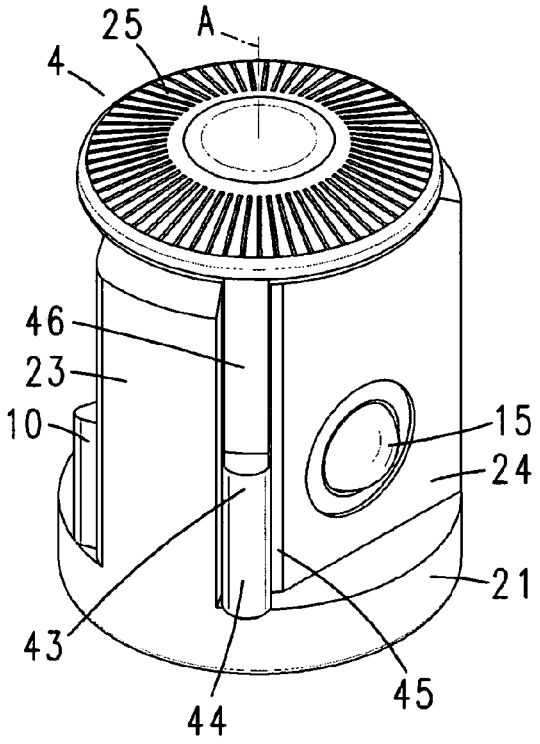
FIG. 34 shows the pivot pin of the embodiment according to FIG. 33 in a perspective representation on its own, for the releasing position.
Figure 35:
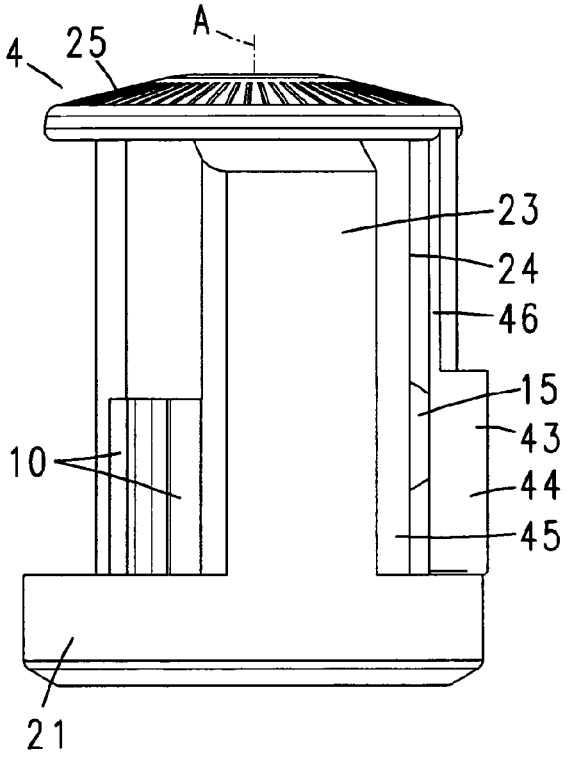
FIG. 35 shows the pivot pin in side view, for the blocking position.
Figure 36:
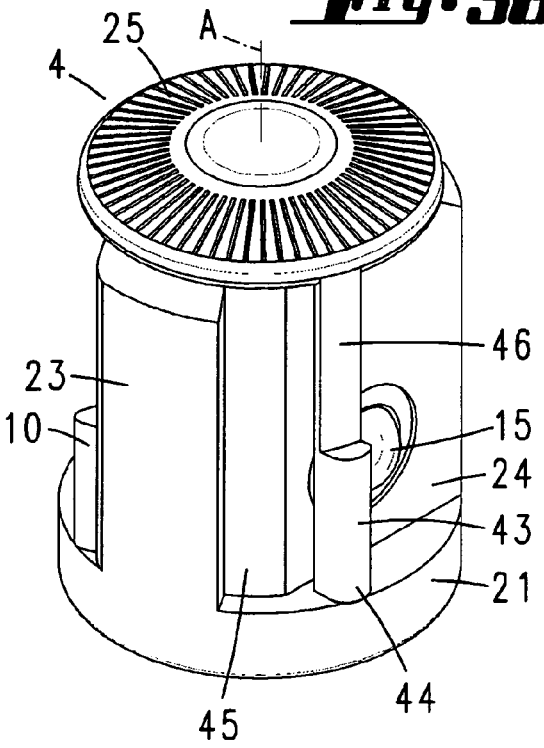
FIG. 36 shows the pivot pin according to FIG. 35 in perspective representation.

FIGS. 26 to 32 show a further embodiment, the representation in FIG. 26 relating to a pivot pin 4 which is displaceable in a sliding manner along the pivot axis A as an alternative way of overcoming the interlock according to the first exemplary embodiment. The further representations (FIG. 27 to FIG. 32) show a configuration with a pivot pin 4 which is not displaceable in a sliding manner in the way described above.

The pivot pin 4 is provided with a radially protruding driving projection 41 in the region of a collar or portion of a narrow side 22 of the trapezoid that interacts with the leg bore 19. In a projection onto a plane directed transversely in relation to the pivot axis A, said driving projection reaches beyond the periphery of the bore 19 and enters a driving recess 42, which is formed radially outside the bore 19 and runs radially inward into the periphery of the bore. In the case of a configuration of the pivot pin 4 according to the representations in FIGS. 27 to 32, this driving recess 42 has an axial depth which corresponds to the axial height of the driving projection 41. If, on the other hand, a slidingly displaceable pivot pin 4 according to the representation in FIG. 26 is provided, the driving recess 42 is configured as a through-opening when viewed in the axial direction; it opens correspondingly axially inward in the case of a preferred arrangement of the driving recess 42, in a projection within the longitudinal slot 9, in the direction of the longitudinal slot 9, whereby the driving projection 41 is provided with an escape space for the elective sliding displacement of the pivot pin 4 along the pivot axis A to overcome the interlock. Accordingly, the driving recess 42 has in this embodiment at least an axial depth which corresponds to the travel when the pivot pin 4 moves in the direction of the pivot axis A plus the axial thickness of the driving projection 41.

When considered in the circumferential direction of the associated bore 19, the driving recess 42 has a length which substantially corresponds to the usual path of pivoting of the movable pliers leg 3 between a mouth closed position and a mouth open position. So, with respect to the pivot axis A, the driving recess 42 extends over an angle of approximately 25°.

The pivot pin 4 is pivotably held in the movable leg 3. The driving recess 42, in which the driving projection 41 lies, follows the pivoting movement of the movable pliers leg 3, while furthermore, in a pliers mouth closed position, as represented for example in FIG. 28, the driving projection 41 engages against an end of the driving recess 42.

The usual leg movement when handling the pliers 1 does not have any effect on the driving projection 41 on account of the longitudinal-slot-like driving recess 42. Only when the peripheral edge of the driving recess 42, that is brought up to the driving projection 41 by opening of the leg, makes abutting contact does positively locking engagement occur, which, with further pivoting displacement of the movable pliers leg 3 beyond the usual extent to which the pliers mouth is opened, causes the driving projection 41 to be pulled along by the driving recess 42. The radially directed driving projection 41 acts in the manner of a lever on the pivot pin 4, which is thereby forcibly displaced in a rotational manner, this leading to the interlock being overcome (cf. FIGS. 30 and 31). Here, too, a turning moment is imparted to the pivot pin 4 by way of the pliers leg 3, pivoted beyond the usual opening extent, and by way of the positively locking engagement between the driving recess 42 and the driving projection 41, this occurring furthermore while overcoming the force of the spring 13 lying in the bore 17 and acting on the flank 14 by way of the ball 15.

Keeping the movable pliers leg 3 in the over-wide mouth open position, the pivot pin 4 remains in the disengaged position in relation to the tooth formation of the longitudinal slot 9, as a result of which a longitudinal displacement of the movable pliers leg 3 along the longitudinal slot 9 into the desired position can take place. Releasing the force acting on the driving projection 41, i.e. letting go of the pliers leg 3 or returning the same in the direction of a mouth closed position, achieves the interlocking engagement in the desired mouth width position.

In the case of this embodiment, the overcoming of the interlocking engagement can be brought about from any engaged position along the longitudinal slot 9.

FIGS. 33 to 44 show three different embodiments for making specific blocking of the disengaging capability of the pivot pin 4 in the transverse direction possible, brought about for example by pulling on the movable pliers leg 3 or by specific pivoting drive of the pivot pin 4, by way of positively locking driving according to the embodiment in the representations of FIGS. 26 to 32 or by way of forced camming action according to the embodiments in FIGS. 18 to 25, while furthermore, in spite of blocking, the overcoming of the engagement by specific, i.e. deliberate, displacement of the pivot pin 4 along the pivot axis A is entirely possible.

Thus, in first instance in one embodiment (FIGS. 33 to 36), the knob part 25 of the pivot pin 4 is provided such that it is pivotable with respect to the pivot pin about the pivot axis A, at least over a partial region. The knob part 25 is, furthermore, formed in the manner of a dish, accordingly rises up in a segmental manner, in a projection onto a plane directed transversely in relation to the pivot axis A, over the area 24 of the trapezoid from which the ball 15 emerges. On the underside, facing the area 24, the knob part 25 is provided with a pin 43 extending parallel to the pivot axis A. When considered in the direction of the pivot axis A, this pin extends over the entire length of the area 24 to the base 21. The pin 43 is held in a rotationally fixed manner on the knob part 25.

Furthermore, the pin 43 is provided at the axial height of the engaging teeth 10 with a thickening 44, which, when the knob part 25 is turned correspondingly, enters the interstitial free space 38 established in the interlocking position between the area 24 of the trapezoid and the associated flank 14 of the longitudinal slot (cf. FIG. 33) and so prevents the possibility of the pivot pin 4 pivoting about its pivot axis A. Accordingly, the pivot pin 4 cannot leave the tooth formation by turning about its pivot axis A. In this situation, the area 24 of the trapezoid is supported on the flank 14 of the longitudinal slot by way of the thickened portion 44 of the pin 43. Accordingly, no free space remains for the engaging teeth 10 to disengage.

When considered in the pivoting direction of the pin 43, provided in the pivot pin 4 at the end of the area 24 of the trapezoid is a pocket-like recess 45, which is set back with respect to the area 24. The pin 43, in particular its thickened portion 44, enters this recess to release the pivoting of the pivot pin 4, this occurring by way of rotational actuation of the knob part 25. In this pivoted-back position according to the representation in FIG. 34, the pin 43, in particular its thickening 44, lies in the recess 45 such that it does not protrude beyond the plane of the area 24. In this position, the interstitial space 38 is clear, so that a pivoting displacement of the pivot pin 4 about its pivot axis A can take place to overcome the interlocking engagement by way of actuating the pliers legs according to the exemplary embodiments described above.

Deliberate sliding displacement of the pivot pin 4 in the direction of the pivot axis A, in which the engaging teeth 10 are disengaged from the counter teeth 11 of the longitudinal slot 9 by linear displacement, causes the portion 46 of the pin 43 that is narrower in comparison with the thickened portion 44 to arrive in the region of the longitudinal slot 9, which makes the sliding displacement of the pivot pin 4 within the longitudinal slot 9 for adjustment of the mouth width possible even in the pin blocking position.

Figure 37:
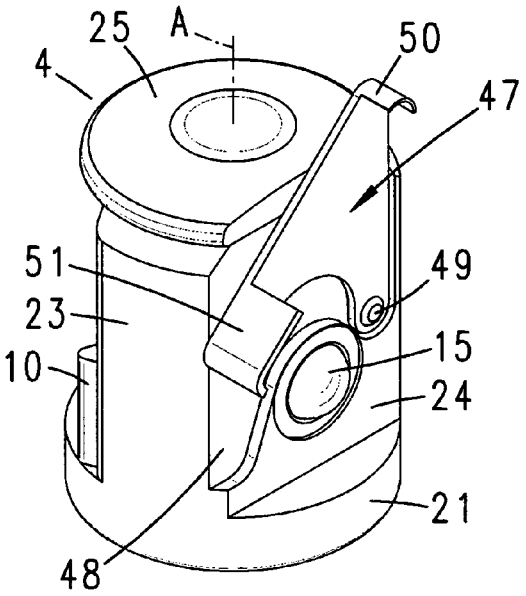
FIG. 37 shows the pivot pin in perspective representation in a further embodiment with a blocking lever, for the releasing position.
Figure 38:
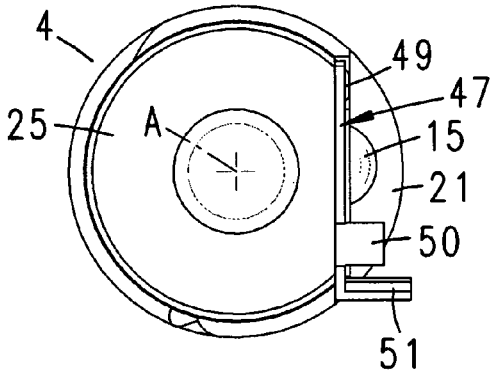
FIG. 38 shows the plan view thereof.
Figure 39:
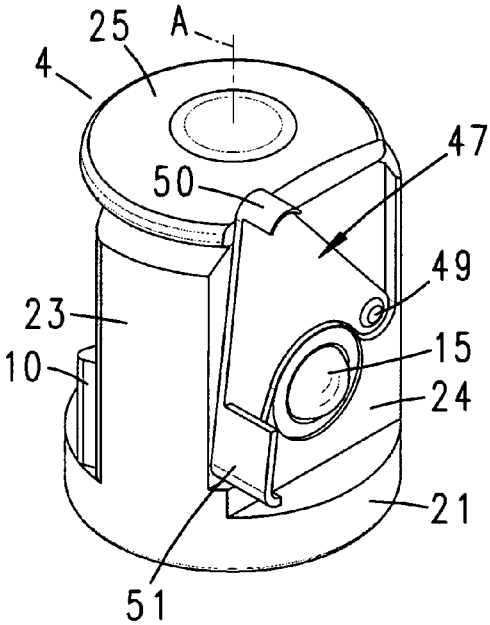
FIG. 39 shows a perspective representation corresponding to FIG. 37, but for the blocking position for preventing the rotational displacement of the pivot pin.
Figure 41:
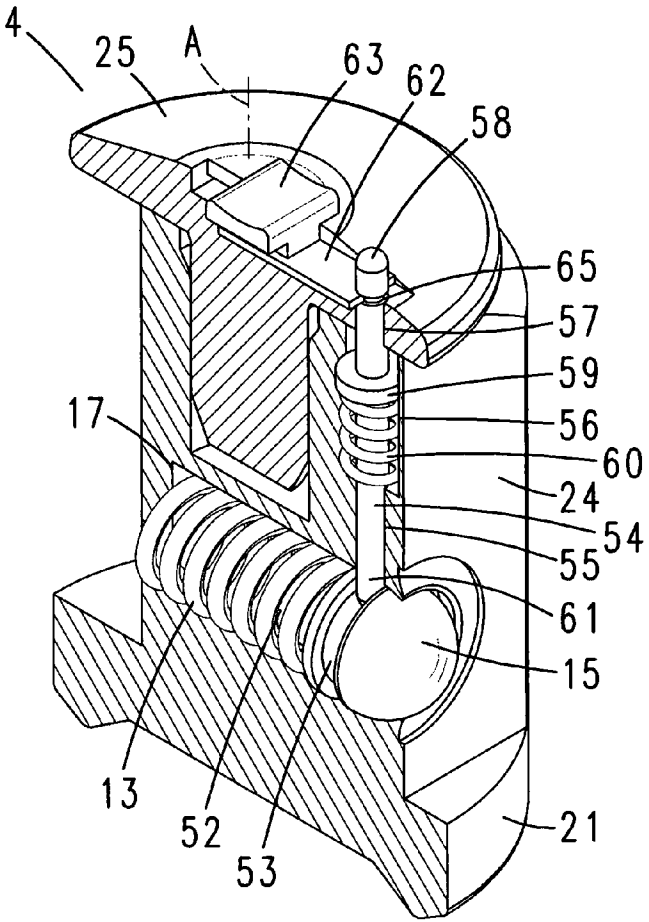
FIG. 41 shows a perspective representation of a longitudinal section through the pivot pin according to FIG. 40, for a blocking position of the pivot pin ball.
Figure 40:
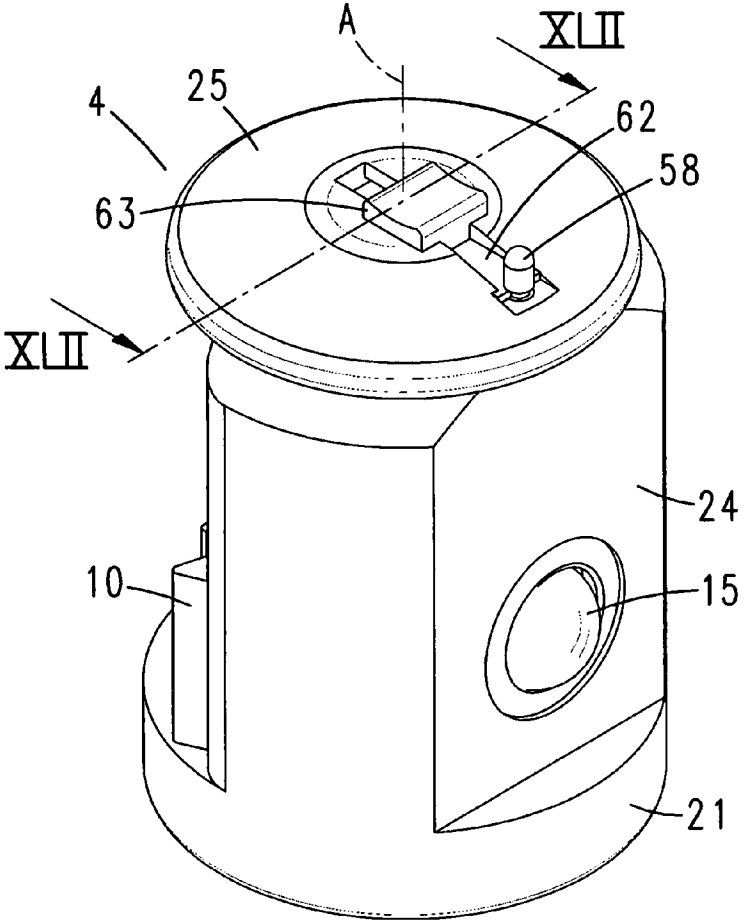
FIG. 40 shows the pivot pin of a further embodiment on its own in a perspective representation.
Figure 42:
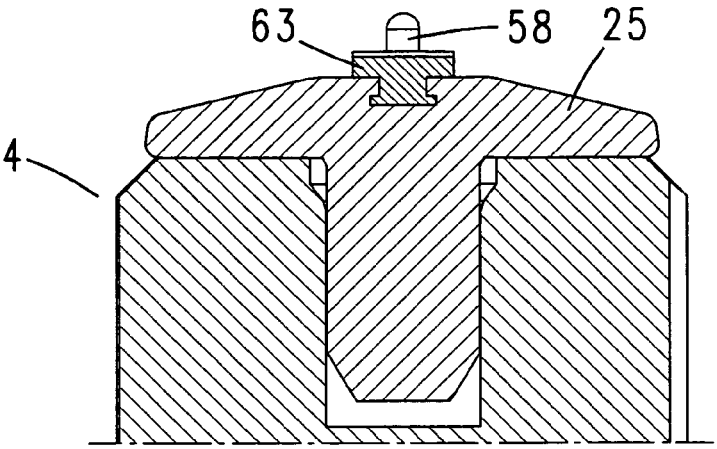
FIG. 42 shows a detail of the pivot pin in a sectional representation along the sectional plane XLII in FIG. 40.
Figure 43:
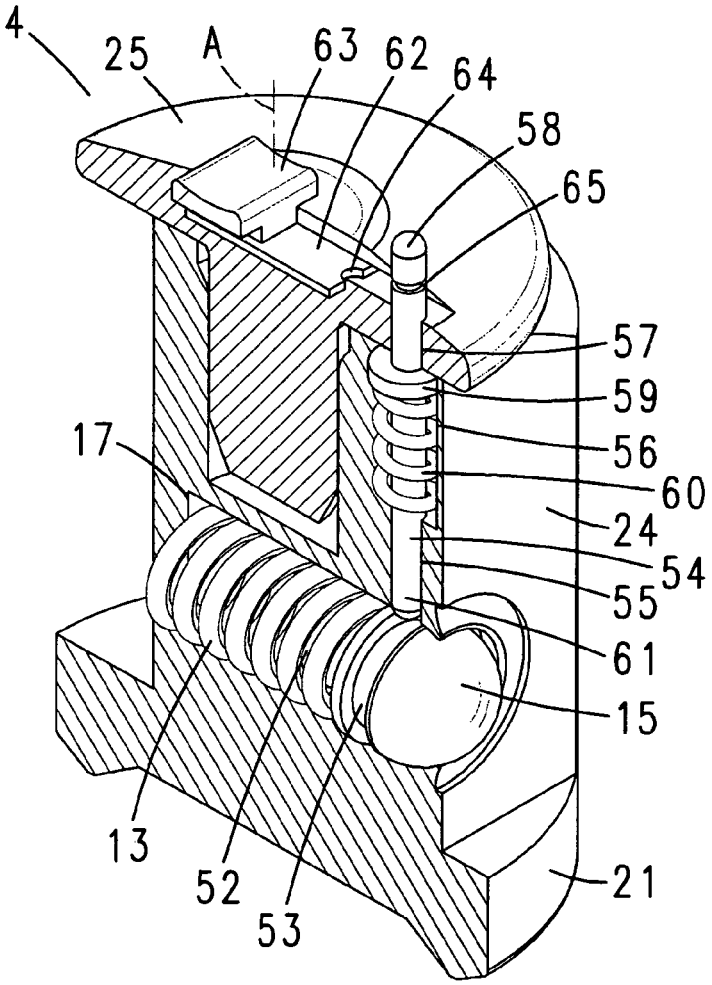
FIG. 43 shows a perspective sectional representation according to FIG. 41; but for the releasing position of the pivot pin ball.
Figure 44:
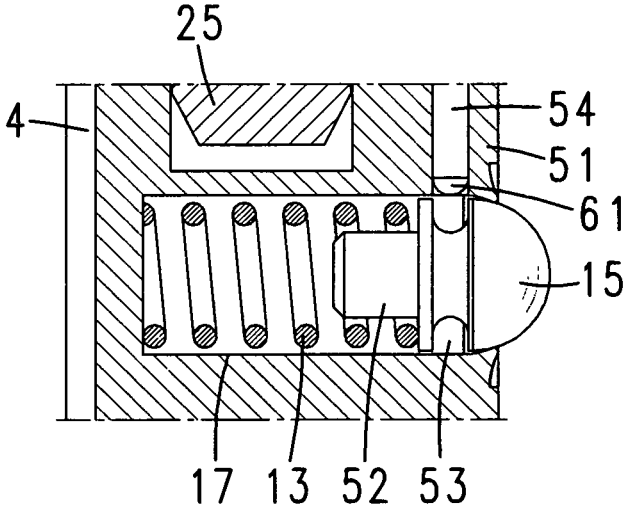
FIG. 44 shows a representation of a detail in a sectional plane directed transversely in relation to the representation in FIG. 42, for the region of the pivot pin ball in the releasing position.

FIGS. 37 to 39 show an alternative configuration. Provided here for blocking the rotatability of the pivot pin 4 to overcome the interlocking engagement, facing the area 24 of the trapezoid, is an initially plate-shaped blocking element 47, extending parallel to the area 24. This blocking element initially lies in a depression 48 of the area 24, while furthermore the depth of the depression 48, as considered transversely in relation to the pivot axis A, corresponds to the thickness of the blocking element 47 considered in the same direction. To this extent, the outwardly directed surface of the blocking element 47 is in line with the remaining area 24 of the pivot pin 4.

The blocking element 47 is pivotable about an axis directed perpendicularly in relation to the pivot axis A. The pivoting axis is provided with the reference numeral 49. With the blocking element 47 approximately triangular overall in plan view, the pivoting axis 49 is provided in a corner region. A further corner region, which protrudes above the knob part 25 in every pivoting position, forms a handling portion 50. The third corner region carries a blocking shoulder 51, which is directed perpendicularly in relation to the pivot axis A.

With respect to the bore 17 accommodating the spring 13 and the ball 15, the pivoting axis 49 is disposed on the mouth side of the area 24. With respect to this bore 17, the blocking shoulder 51 is positioned opposite the pivoting axis 49.

The blocking element 47 is further formed, for example, in the form of a bent sheet-metal part.

The handling portion 50 enables the user, for example by actuating it with his thumb, to pivot the blocking element 47 out of a pivot-pin releasing position, represented in FIG. 37, into a blocking position according to FIG. 39. In this position, the blocking shoulder 51 engages in the interstitial free space 38 established between the area 24 and the facing flank 14 of the longitudinal slot, whereby the pivot pin 4 is blocked against turning about the pivot axis A. Accordingly, overcoming of the interlocking engagement cannot be brought about by means of pulling or rotational loading by way of the movable leg 3. Overcoming of this interlocking engagement by linear displacement of the pivot pin 4 along the pivot axis A continues to be possible even in this blocking element position. In the course of the sliding displacement of the pivot pin 4, the blocking shoulder 51 comes out of the region associated with the longitudinal slot 9.

Finally, FIGS. 40 to 44 show an exemplary embodiment in which blocking of the disengaging capability in the transverse direction is achieved by blocking the ball 15 lying in the bore 17. This ball accordingly cannot retract by transverse actuation, for example by corresponding pulling on the movable pliers leg 3 or as a result of loading of the pivot pin 4 brought about by a forced rotational displacement. Accordingly, there is no free space to move the engaging teeth 10 out of the counter tooth formation.

For this purpose, the ball 15 is formed initially, in the outwardly facing direction, in the manner of a spherical cap, with a cylindrical portion 52 inwardly entering the bore 17. This cylindrical portion is rearwardly loaded by the compression spring 13.

The cylindrical portion 52 is provided with an encircling groove 53.

In the disengaged position of the ball 15, a blocking pin 54 is associated with the groove 53. This blocking pin extends perpendicularly in relation to the bore 17, and consequently parallel to the pivot axis A, within a correspondingly directed bore 55 of the pivot pin 4. This bore 55 opens at one end in the bore 17 accommodating the spring 13 and the ball 15 and at the other end in the region of a radial widening 56 underneath the collar area of the knob part 25 substantially covering the bore 55. The knob part 25 itself is provided furthermore with an aperture 57, provided to coincide with the bore 55, for an end portion 58 of the blocking pin to pass through.

Furthermore, associated with the radial widening 56 of the bore 55, the blocking pin 54 has a radial collar 59. This radial collar is loaded on the underside, in the direction of the knob part 25, by a compression spring 60 that is in the form of a cylindrical spring and is supported on the base of the radial widening, while furthermore the radial collar 59 forms a stop for engaging against the facing underside of the knob part 25.

By deliberate displacement of the blocking pin 54 counter to the spring force of the compression spring 60, the free end 61 of the pin is brought into the groove 53 of the ball 15 for positively locking engagement, after which the ball 15 is blocked in its extended position.

This blocking position can be locked. Provided for this purpose in the region of the actuating area of the knob part 25 is an actuable slide 62, which can be linearly displaced by way of a handling portion 63 transversely in relation to the pivot axis A, in the direction of the end portion 58 of the blocking pin. The slide 62 has, facing the end portion 58, a recess in the form of a portion of a circle, which, for fixing the blocking pin 54, engages in a radially narrowed region of the end portion 58 of the blocking pin, formed by an encircling groove 65, and so prevents the blocking pin 54 from returning of its own accord into the ball releasing position.

Releasing of the ball 15, and consequently releasing of the blocking of the disengaging capability in the transverse direction, merely requires return displacement of the slide 62, which is accompanied by release of the end portion 58 of the blocking pin. After that, the compression spring 60 is displaced into the basic position while relieving the blocking pin 54, which is accompanied by the end 61 of the pin moving out of the groove 53 of the ball.

All features disclosed are (in themselves) pertinent to the invention. The disclosure content of the associated/accompanying priority documents (copy of the prior patent application) is also hereby incorporated in full in the disclosure of the application, including for the purpose of incorporating features of these documents in claims of the present application.

The invention claimed is:

1. Pliers (1) with two pliers legs (2, 3) crossing at a pivot pin (4), one (3) of which legs is movable and the other (2) is fixed, and with a spring (13) between the fixed leg (2) and the pivot pin (4) acting in such a way as to assist interlocking engagement of the pivot pin (4), the pliers legs (2, 3) forming gripping portions (5, 6) on one side of the pivot pin (4) and a pliers mouth being formed on the other side of the pivot pin (4), furthermore the pivot pin (4), through which a pivot axis (A) of the movable pliers leg at the same time extends, being adjustable in a longitudinal slot (9) of the fixed pliers leg (2), and it being possible for the movable pliers leg (3) to be fixed by choice in relation to the fixed pliers leg (2) by means of interlocking engagement between the pivot pin (4) and the longitudinal slot (9) that takes place in the direction of a plane defined by the pliers legs (2, 3), wherein the pivot pin (4) is releasable from the interlock merely by pulling loading of the movable pliers leg (3) transversely in relation to the longitudinal extent of the longitudinal slot (9), wherein further the interlock can be overcome at choice by moving the pivot pin (4) counter to the force of the spring (13) or by moving the pivot pin (4) in the direction of the pivot axis (A).

2. Pliers according to claim 1, wherein the movement of the pivot pin (4) is accompanied by a turning about the pivot axis (A).

3. Pliers according to claim 1, wherein the turning is achieved by an off-center actuation of the pivot pin (4) with respect to the longitudinal slot (9).

4. Pliers according to claim 1, wherein the pivot pin (4) is captured with positively locking engagement in a pliers leg (3) such that it is rotationally driven along by the pivoting movement, it only beginning to be carried along by the pivoting movement when the pliers mouth is partially open.

5. Pliers according to claim 1, wherein the spring (13) only acts upon the pivot pin (4).

6. Pliers according to claim 1, wherein the spring (13) is supported on a portion of the fixed leg (2) that forms the longitudinal slot (9).

7. Pliers according to claim 1, wherein the pivot pin (4) is movable in the longitudinal slot (9) transversely in relation to the longitudinal extent of the latter.

8. Pliers according to claim 1, wherein the spring (13) is accommodated in the pivot pin (4) with a direction of action that is transverse to the longitudinal axis (pivot axis A) of the latter.

9. Pliers according to claim 1, wherein the spring (13) acts on a spherical body (15).

10. Pliers according to claim 1, wherein a spherical body (15) is held in a bore (17) of the pivot pin (4), in which the spring (13) is also accommodated.

11. Pliers according to claim 1, wherein during interlocking engagement, the pivot pin (4) lies against an opposite flank, partially directly and partially by way of the spring (13).

12. Pliers according to claim 1, wherein a tooth formation is formed only on one longitudinal flank of the fixed pliers leg (2).

13. Pliers according to claim 1, wherein a tooth formation has flank angles which can be run over in the closing direction of the pliers mouth.

14. Pliers according to claim 13, wherein a flank angle in the closing direction encloses an angle of 50° to 70°, with a longitudinal axis of the longitudinal slot.

15. Pliers according to claim 13, wherein a counter flank encloses a flank angle of 80° to 100°, with the longitudinal axis.

16. Pliers according to claim 1, wherein the longitudinal slot (9) is formed such that it extends in a curved manner in the longitudinal direction.

17. Pliers according to claim 1, wherein the pivot pin (4) has two opposite flattened sides, only one of the sides being provided with engaging teeth (10) that are formed for the interlocking engagement.

18. Pliers according to claim 14, wherein the flank angle in the closing direction encloses the angle of 60°, with the longitudinal axis of the longitudinal slot.

19. Pliers according to claim 15, wherein the counter flank encloses the flank angle of 90°, with the longitudinal axis.

* * * * *

UNITED STATES PATENT AND TRADEMARK OFFICE

CERTIFICATE OF CORRECTION

PATENT NO. : 8,695,464 B2
APPLICATION NO. : 12/312062
DATED : April 15, 2014
INVENTOR(S) : Bernd Herrmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1342 days.

Signed and Sealed this
Twenty-ninth Day of September, 2015

Michelle K. Lee

Michelle K. Lee
*Director of the United States Patent and Trademark Office*